US006023208A

United States Patent [19]

Tada et al.

[11] Patent Number: 6,023,208

[45] Date of Patent: Feb. 8, 2000

[54] DIELECTRIC FILTER

[75] Inventors: Hitoshi Tada; Hiromi Ogura, both of Ishikawa-ken, Japan

[73] Assignee: Murata Manufacturing Co., Ltd., Japan

[21] Appl. No.: 09/260,764

[22] Filed: Mar. 2, 1999

Related U.S. Application Data

[62] Division of application No. 08/761,984, Dec. 11, 1996, Pat. No. 5,912,603.

[30] Foreign Application Priority Data

Dec. 12, 1995 [JP] Japan ..... 7-323154

[51] Int. Cl.[7] ..... H01P 1/205

[52] U.S. Cl. ..... 333/206; 333/222

[58] Field of Search ..... 333/202, 206, 333/207, 222, 223

[56] References Cited

U.S. PATENT DOCUMENTS

| | | | |
|---|---|---|---|
| 4,151,494 | 4/1979 | Nishikawa et al. | 333/204 |
| 4,806,889 | 2/1989 | Nakano et al. | 333/206 X |
| 5,130,683 | 7/1992 | Agahi-Kesheh et al. | 333/203 |
| 5,489,882 | 2/1996 | Ueno | 333/206 |
| 5,525,946 | 6/1996 | Tsujiguchi et al. | 333/202 |
| 5,712,604 | 1/1998 | Tada et al. | 333/202 |

FOREIGN PATENT DOCUMENTS

| | | |
|---|---|---|
| 0645836 | 3/1995 | European Pat. Off. . |
| 6-238601 | 2/1987 | Japan . |
| 6-469102 | 3/1989 | Japan . |
| 2241203 | 8/1990 | Japan . |
| 451602 | 2/1992 | Japan . |
| 4150101 | 5/1992 | Japan . |

OTHER PUBLICATIONS

Patents Abstracts of Japan—E–1257 Sep. 2, 1992, vol. 16/No. 415.

*Primary Examiner*—Seungsook Ham

*Attorney, Agent, or Firm*—Ostrolenk, Faber, Gerb & Soffen, LLP

[57] ABSTRACT

A dielectric filter, includes a dielectric block including a plurality of elongated sub-blocks each having a pair of longitudinally opposing end faces and an outer surface, said sub-blocks being disposed adjacent one another; a plurality of longitudinally extending through-holes, at least one through-hole being formed between each corresponding pair of opposing end faces of the respective sub-blocks; a plurality of inner conductors, one inner conductor being formed on each of the inner surfaces of said plurality of through-holes, said plurality of inner conductors each having two opposing ends; an outer conductor formed on the outer surface of said dielectric block such that (i) the outer conductor is not electrically coupled to the respective ends of the inner conductor of every other sub-block such that the ends of those inner conductors are open-circuited, and (ii) the outer conductor is electrically coupled to the respective ends of the inner conductor of the remaining sub-blocks such that the ends of those inner conductors are short-circuited; a plurality of connection conductors through which respective parts of the inner conductors located between corresponding open-circuited opposing ends are connected to said outer conductor; and an electromagnetic coupling preventing structure formed between each adjacent pair of sub-blocks and extending from one end face of each of said sub-blocks toward a central part of said sub-blocks between the two opposing end faces, wherein said dielectric filter produces a band elimination transfer function over some frequencies and a pass transfer function over other frequencies in use.

47 Claims, 26 Drawing Sheets

DIELECTRIC FILTER

This is a division of application Ser. No. 08/761,984, filed Dec. 11, 1996, now U.S. Pat. No. 5,912,603.

BACKGROUND OF THE INVENTION

1. Field of the Invention

The present invention relates to a dielectric filter, and more particularly, to a dielectric filter suitable for use as a band-elimination filter in a mobile communication device or the like.

2. Description of the Related Art

FIG. 36 illustrates a conventional band-elimination filter including a dielectric resonator 121, a coupling capacitor 122, and a lead terminal 123 connecting the coupling capacitor 122 to the dielectric resonator 121.

The dielectric resonator 121 is composed of a rectangular dielectric block 124 having a through-hole 125. The inner wall of the through-hole 125 is covered with an inner conductor 126. The outer surface of the dielectric block 124 is covered with an outer conductor 127. One end of the inner conductor 126 is connected to the outer conductor 127. The coupling capacitor 122 is composed of a dielectric substrate 128 having capacitor electrodes 129 and 130 formed on either side of the dielectric substrate 128.

The inner conductor of the dielectric resonator 121 is connected to one capacitor electrode 129 of the coupling capacitor 122 via the lead terminal 123. The other capacitor electrode 130 of the coupling capacitor 122 is connected to a signal line disposed on a circuit board. The outer conductor 127 is connected to a ground line disposed on the circuit board. The dielectric filter having the above structure acts as a band-elimination filter with an equivalent circuit shown in FIG. 37.

As described above, the conventional dielectric filter includes not only the dielectric resonator 121 but also the coupling capacitor 122 and the lead terminal 123. As a result, troublesome manipulation is required to mount a dielectric filter of this type on a circuit board.

FIG. 38 illustrates a typical frequency characteristic obtained in a conventional dielectric filter of the type described above. As can be seen from FIG. 38, the dielectric filter has a simple trap frequency ft with no attenuation in frequency bands is around the trap frequency ft. Therefore, when it is desirable that the filter have attenuation property in a frequency band either higher or lower than the trap frequency, it is required to couple the filter with another dielectric filter acting as a band-pass filter. This makes it more difficult to mount the filters.

SUMMARY OF THE INVENTION

Thus, it is an object of the present invention to provide a dielectric filter which acts not only as a band-elimination filter but also as a band-pass filter exhibiting attenuation at the edges of the pass-bands at higher and lower frequencies than the trap frequency and which can be easily mounted on a circuit board.

To achieve the above object, the present invention provides a dielectric filter with various features and aspects as described below. According to a first aspect of the present invention, there is provided a dielectric filter including: a dielectric block having a pair of opposing end faces; a through-hole formed between the pair of opposing end faces of the dielectric block; an inner conductor formed on the inner surface of the through-hole, the inner conductor being open-circuited at both its ends; an outer conductor formed on the outer surface of the dielectric block; and a connection conductor by which a central part of the inner conductor between its two opposing ends is connected to the outer conductor.

In this dielectric filter, an inductor is formed by the connection conductor by which the central part of the inner conductor between its two opposing ends is connected to the outer conductor. This allows the dielectric filter to behave as a band-elimination filter is having band-pass characteristics at frequencies higher and lower than a trap frequency wherein elimination occurs at both band edges of the pass-bands.

According to a second aspect of the present invention based on the above first aspect, there is provided a dielectric filter in which the dielectric block further includes a side-wall through-hole extending from the central part of the inner surface between the two opposing ends of the through-hole to the outer surface of the dielectric block, and the above-described connection conductor is disposed in this side-wall through-hole.

In this dielectric filter, since the connection conductor is disposed in the side-wall through-hole, it is possible for the inductor to have a stable inductance.

According to a third aspect of the present invention, there is provided a dielectric filter including: a dielectric block including a plurality of sub-blocks each having a pair of opposing end faces; a plurality of through-holes formed between the pairs of opposing end faces of the respective sub-blocks of the dielectric block; a plurality of inner conductors formed on the inner surfaces of the plurality of through-holes, the plurality of inner conductors being open-circuited at their both ends; an outer conductor formed on the outer surface of the dielectric block; and a plurality of connection conductors by which the central parts of the respective inner conductors between their two opposing ends are connected to the outer conductor, wherein the plurality of sub-blocks of the dielectric block are shifted in position relative to one another toward either of the pair of opposing ends.

In this arrangement, the dielectric filter is composed of a plurality of filter stages in which the respective sub-blocks of the dielectric block are shifted in position relative to one another toward either of the pair of the opposing ends thereby avoiding undesirable coupling among the filter stages. This structure allows the trap band to have greater attenuation and also allows the frequency bandwidth of the trap band to be adjusted to a desired value. Thus, it is possible to realize a high-performance band-elimination filter having band-pass regions at frequencies higher and lower than a trap frequency wherein elimination occurs at both band edges of the pass-bands.

According to a fourth aspect of the present invention, there is provided a dielectric filter including: a dielectric block including a plurality of sub-blocks each having a pair of opposing end faces; a plurality of through-holes formed between the pairs of opposing end faces of the respective sub-blocks of the dielectric block; a plurality of inner conductors formed on the inner surfaces of the plurality of through-holes, the plurality of inner conductors being open-circuited at both their ends; an outer conductor formed on the outer surface of the dielectric block; and a plurality of connection conductors by which the central parts of the respective inner conductors between their two opposing ends are connected to the outer conductor, wherein the dielectric block is formed in a rectangular shape, and a coupling-preventing structure is formed between adjacent sub-blocks in such a manner that the coupling-preventing structure extends from one end face toward a central part between the two opposing end faces.

In this arrangement, the dielectric filter is composed of a plurality of filter stages in which the is coupling preventing structure is provided between adjacent sub-blocks of the dielectric block thereby preventing undesirable coupling among the filter stages. This structure allows the trap band to have greater attenuation and also allows the frequency bandwidth of the trap band to be adjusted to a desired value. Thus, it is possible to realize a high-performance band-elimination filter having band-pass regions at frequencies higher and lower than a trap frequency wherein elimination occurs at both band edges of the pass-bands.

According to a fifth aspect of the present invention based on the above third or fourth aspect, there is provided a dielectric filter in which the dielectric block further includes a side-wall through-hole extending from the central part of the through-hole between its two opposing ends to the outer surface of the dielectric block, and the connection conductor is disposed in this side-wall through-hole.

In this dielectric filter, since the connection conductor is disposed in the side-wall through-hole, it is possible for the inductor to have a stable inductance.

According to a sixth aspect of the present invention, there is provided a dielectric filter including: a dielectric block including a first sub-block and a second sub-block each having its own pair of opposing end faces; a through-hole formed between the pair of opposing end faces of the first sub-block of the dielectric block; an inner conductor formed on the inner surface of the through-hole, the inner conductor being open-circuited at both its ends; an outer conductor formed on the outer surface of the dielectric block; a connection conductor by which a central part of the inner conductor between its two opposing ends is connected to the outer conductor; a through-hole formed between the pair of opposing end faces of the second sub-block of the dielectric block; and an inner conductor formed on the inner surface of the through-hole of the second sub-block, the inner conductor being short-circuited at both its outer ends, the inner conductor having open-circuited inner ends located at a center between its two outer ends; wherein the dielectric block is formed in a rectangular shape, and an electromagnetic coupling preventing structure is formed between adjacent sub-blocks in such a manner that the electromagnetic coupling preventing structure extends from one end face toward a central part between the two opposing end faces.

In this arrangement, the dielectric filter is composed of a plurality of filter stages in which an electromagnetic coupling-preventing structure is provided between adjacent sub-blocks of the dielectric block thereby preventing undesirable coupling among the filter stages. This structure allows the trap band to have greater attenuation and also allows the frequency bandwidth of the trap band to be adjusted to a desired value. Thus, it is possible to realize a high-performance band-elimination filter having band-pass regions at frequencies higher and lower than a trap frequency wherein elimination occurs at both band edges of the pass-bands.

According to a seventh aspect of the present invention, there is provided a dielectric filter including: a dielectric block including a first sub-block and a second sub-block each having its own pair of opposing end faces; a through-hole formed between the pair of opposing end faces of the first sub-block of the dielectric block; an inner conductor formed on the inner surface of the through-hole, the inner conductor being open-circuited at both its ends; an outer conductor formed on the outer surface of the dielectric block; a connection conductor by which a central part of the inner conductor between its two opposing ends is connected to the outer conductor; a through-hole formed between the pair of opposing end faces of the second sub-block of the dielectric block; and an inner conductor formed on the inner surface of the through-hole of the second sub-block, the inner conductor being short-circuited at both its outer ends, the inner conductor having open-circuited inner ends located at a center between its two outer ends; wherein the plurality of sub-blocks of the dielectric block are shifted in position relative to one another toward either of the pair of opposing ends.

In this arrangement, the dielectric filter is composed of a plurality of filter stages in which the respective sub-blocks of the dielectric block are shifted in position relative to one another toward either of the pair of the opposing ends thereby preventing undesirable coupling among the filter stages. This structure allows the trap band to have greater attenuation and also allows the frequency bandwidth of the trap band to be adjusted to a desired value. Thus, it is possible to realize a high-performance band-elimination filter having band-pass regions at frequencies higher and lower than a trap frequency wherein elimination occurs at both band edges of the pass-bands.

According to an eighth aspect of the present invention, based on the above sixth or seventh aspect, the dielectric block further includes a side-wall through-hole extending from the central part of the through-hole between its two opposing ends to the outer surface of the dielectric block, and the connection conductor is disposed in this side-wall through-hole.

In this dielectric filter, since the connection conductor is disposed in the side-wall through-hole, it is possible for the inductor to have a stable inductance.

Other features and advantages of the present invention will become apparent from the following description of the invention which refers to the accompanying drawings.

BRIEF DESCRIPTION OF THE DRAWINGS

is

DESCRIPTION OF EMBODIMENTS OF THE INVENTION

With reference to specific embodiments of dielectric filters, the present invention will be described in further detail below in conjunction with the accompanying drawings.

Figure 1:
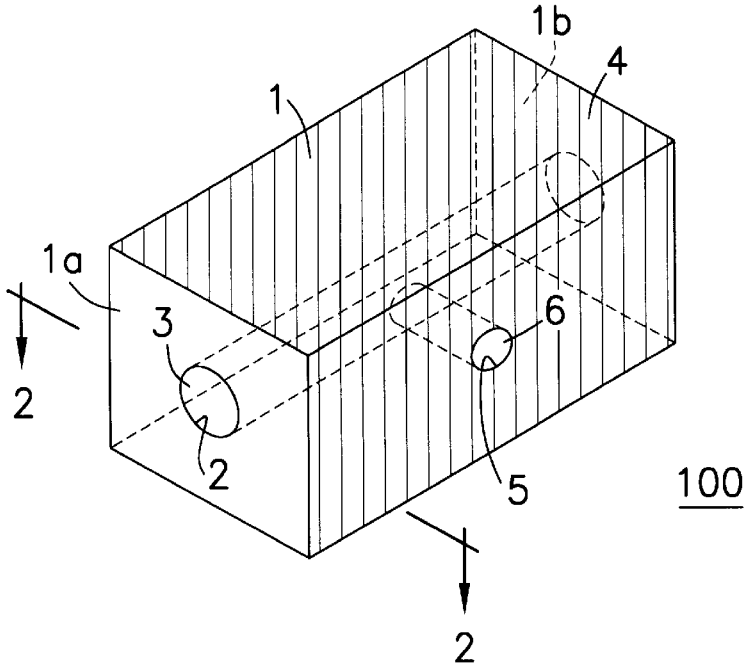
FIG. 1 is a perspective view of a first embodiment of a dielectric filter according to the present invention.
Figure 2:
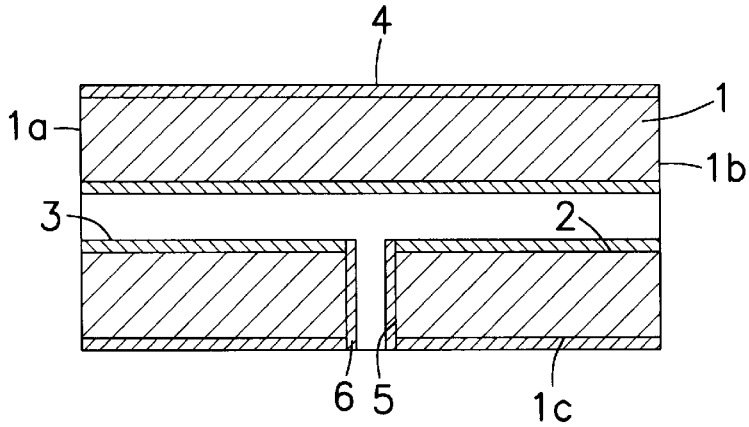
FIG. 2 is a cross-sectional view of the dielectric filter of FIG. 1 taken along line 2—2.

FIG. 1 is a perspective view of a first embodiment of a dielectric filter 100 according to the present invention. FIG. 2 is a cross-sectional view taken along line 2—2 of FIG. 1. As shown in these figures, the dielectric filter includes a rectangular dielectric block 1 made up of a ceramic material. The dielectric block 1 has two opposing end faces 1*a* and 1*b*.

A through-hole 2 is formed between these end faces 1*a* and 1*b*. An inner conductor 3 is formed on the inner wall of the through-hole 2. An outer conductor 4 is formed over the whole outer surface of the dielectric block 1 except its end faces 1*a* and 1*b*. In this structure, the inner conductor 3 is not connected, at either end, to the outer conductor 4 and thus the inner conductor 3 is electrically open-circuited at both its ends. The inner conductor 3 and the outer conductor 4 may be formed, for example, by disposing an electrode material such as Cu over the whole surface of the dielectric block 1 including the inner wall of the through-hole 2 by means of electroless plating or the like, and then removing the electrode material from the end faces 1*a* and 1*b*.

The dielectric block 1 also has a side-wall through-hole 5 extending from a central part of the inner wall of the through-hole 2 between its two opposing ends to the outer surface of the dielectric block 1. A connection conductor 6 is formed on the inner wall of the side-wall through-hole 5 so that the central part of the inner conductor 3 between the two opposing ends is connected to the outer conductor 4 via the connection conductor 6. This connection conductor 6 may be formed at the same time as the inner conductor 3 and the outer conductor 4 by subjecting the side-wall through-hole 5 to the plating process for forming the inner conductor 3 and the outer conductor 4.

Figure 3:
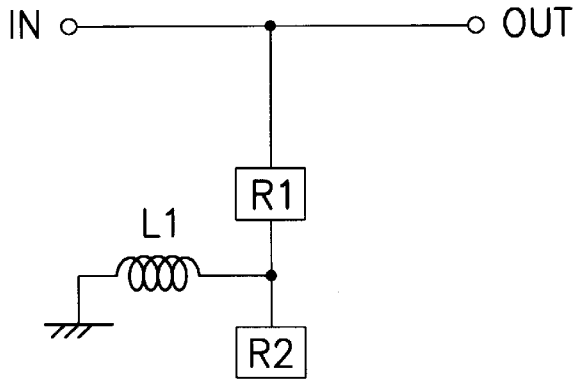
FIG. 3 is a circuit diagram of an equivalent circuit of the dielectric filter shown in FIG. 1.
Figure 4:
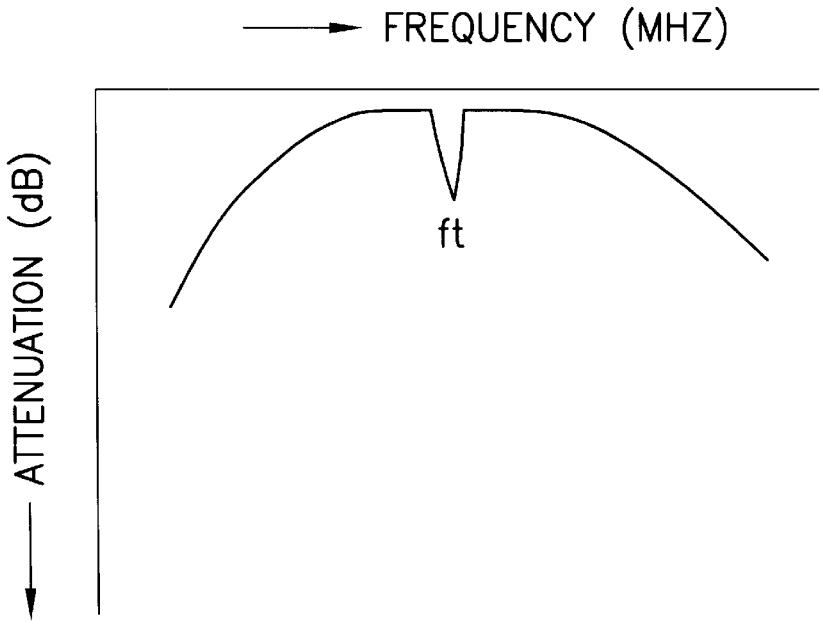
FIG. 4 is a graph illustrating the frequency characteristic of the dielectric filter shown in FIG. 1.

In the dielectric filter having the structure described above, one end of the inner conductor 3 is connected to a signal line while the other end is electrically open-circuited. The outer conductor 4 is connected to a ground line. Thus, the dielectric filter of the present embodiment can be represented by an equivalent circuit shown in FIG. 3. In this equivalent circuit, R1 and R2 are two resonators formed with the inner conductor 3 divided into two sections at the center between the two opposing ends, and L1 is an inductor associated with the connection conductor 6, which is grounded. The dielectric filter represented by the above equivalent circuit has two band-pass regions separated by a trap frequency ft, as shown in FIG. 4, wherein attenuation occurs at both band edges of the pass-bands. The trap frequency ft and the frequency-attenuation characteristics of the two band-pass regions located at either side of the trap frequency ft are determined by properly selecting the relative dielectric constant of the dielectric block 1, the length of the inner conductor 3, and the inductance associated with the connection conductor 6. As described above, the dielectric filter with the above structure behaves both as a band-pass filter and a band-elimination filter with two band-pass regions separated by the trap frequency ft.

Figure 5:
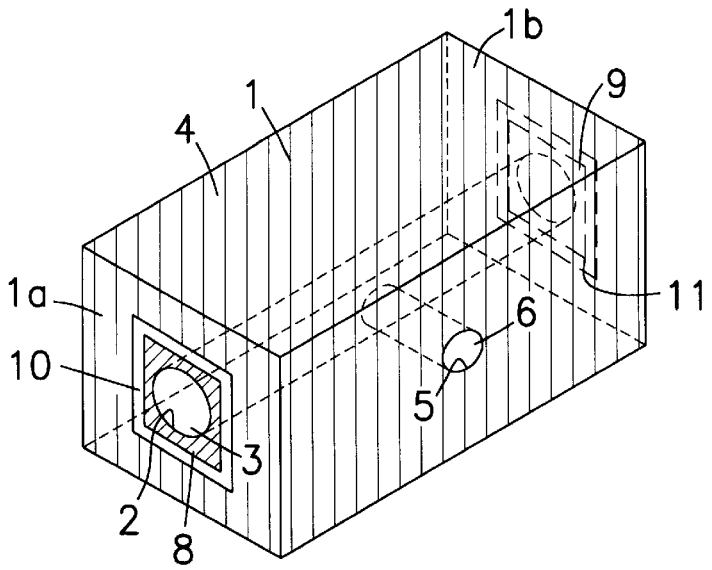
FIG. 5 is a schematic diagram illustrating a modification of the dielectric filter of FIG. 1.

In an alternative mode, as shown in FIG. 5, one end of the inner conductor 3 may be connected to an end face electrode 8 formed on the end face 1*a* in an area surrounding the through-hole 2, and the other end of the inner conductor 3 may be connected to an end face electrode 9 formed on the end face 1*b* in an area surrounding the through-hole 2. In this case, the outer conductor 4 has additional portions extending onto the end faces 1*a* and 1*b* wherein gaps 10 and 11 are formed around the respective end face electrodes 8 and 9 so that the end face electrodes 8 and 9 are electrically isolated from the portions of the outer conductor 4 on the end faces 1*a* and 1*b*. This structure, in which the inner conductor 3 is connected to the end face electrodes 8 and 9, readily permits a signal line to be connected to the inner conductor 3. That is, the connection can be accomplished simply by connecting the signal line to the end face electrode 8 or the end face electrode 9. Furthermore, in the case where the outer conductor 4 is formed by means of plating, the above structure allows the conductors to be more easily formed, because this structure leads to a reduction in the area of the electrode material which must be removed after the plating process.

Figure 6:
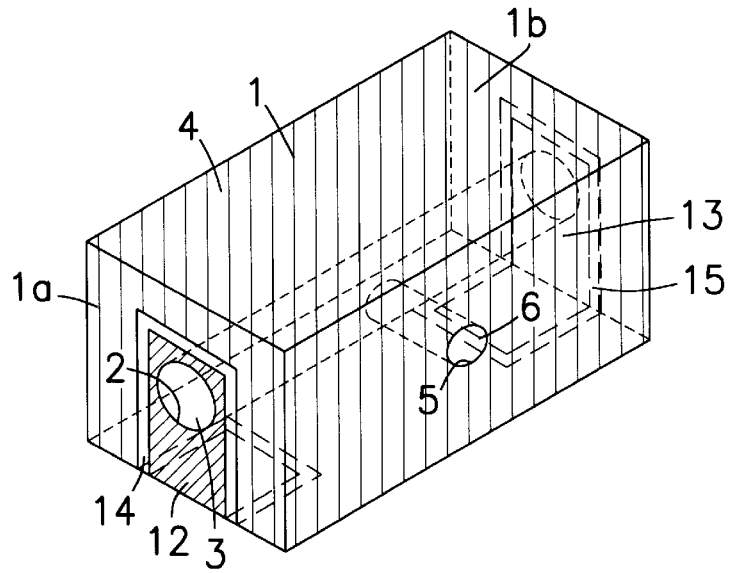
FIG. 6 is a schematic diagram illustrating another modification of the dielectric filter of FIG. 1.

Alternatively, as shown in FIG. 6, the inner conductor 3 may be connected to end face electrodes 12 and 13 wherein the end face electrode 12 has a portion extending across the end face 1*a* surrounding the through-hole 2 and further extending onto the lower side of the dielectric block 1, while the end face electrode 13 has a portion extending across the end face 1*b* surrounding the through-hole 2 and further extending onto the lower side of the dielectric block 1. Also in this case, the outer conductor 4 has additional portions extending onto the end faces 1*a* and 1*b* wherein gaps 14 and 15 are formed around the respective end face electrodes 12 and 13 so that the end face electrodes 12 and 13 are electrically isolated from the portions of the outer conductor 4 on the end faces 1*a* and 1*b*. This structure, in which the inner conductor 3 is connected to the end face electrodes 12 and 13 in the above-described manner, even more readily permits a signal line to be connected the inner conductor 3 than in the structure shown in FIG. 5, because the connection can be accomplished simply by connecting the signal line to the lower-side portion of the end face electrode 12 or the lower-side portion of the end face electrode 13. Furthermore, in the case where the outer conductor 4 is formed by means of plating, the above structure allows the conductors to be easily formed as in the case of the structure shown in FIG. 5, because this structure also leads to a reduction in the area of the electrode material which should be removed after the plating process.

Figure 7:
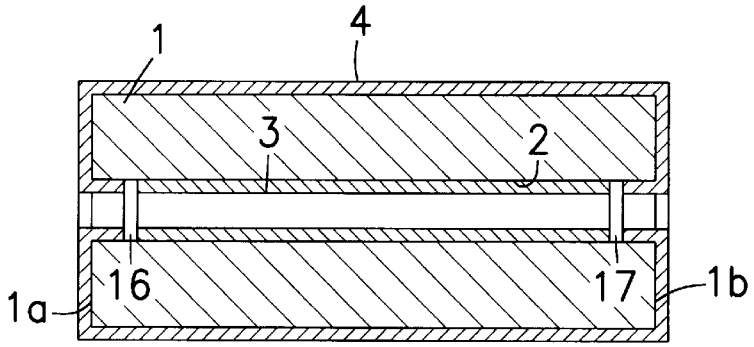
FIG. 7 is a schematic diagram illustrating still another modification of the dielectric filter of FIG. 1.

In still another alternative mode, shown in FIG. 7, the inner conductor 3 may also be formed in such a manner as to have a length which does not reach either the end face 1*a* or the end face 1*b*. In this case, the outer conductor 4 is formed in such a manner as to extend over the whole area of the end face 1*a* and 1*b*, respectively, and further to extend into the through-hole 2. The portions of the outer conductor 4 located on the inner wall of the through-hole 2 are electrically isolated from the inner conductor 3 by gaps 16 and 17. This structure in which the outer conductor 4 is formed in the above-described manner leads to an improvement in the shielding performance of the dielectric filter.

In the above structures, the side-wall through-hole 5 is formed, as described above, in such a manner as to extend from a central part of the inner wall of the through-hole 2 between its two opposing ends to the outer surface of the dielectric block 1, and the connection conductor 6 is formed on the inner wall of the side-wall through-hole 5 in such a manner that the central part of the inner conductor 3 between the two opposing ends is connected to the outer conductor 4 via the connection conductor 6.

As referred to herein, the "central part" between the two ends is not required to be located at the exact geometric center but may be located within a range around the exact geometric center as long as the filter has a good frequency characteristic which obtains the objects of the invention.

Figure 8:
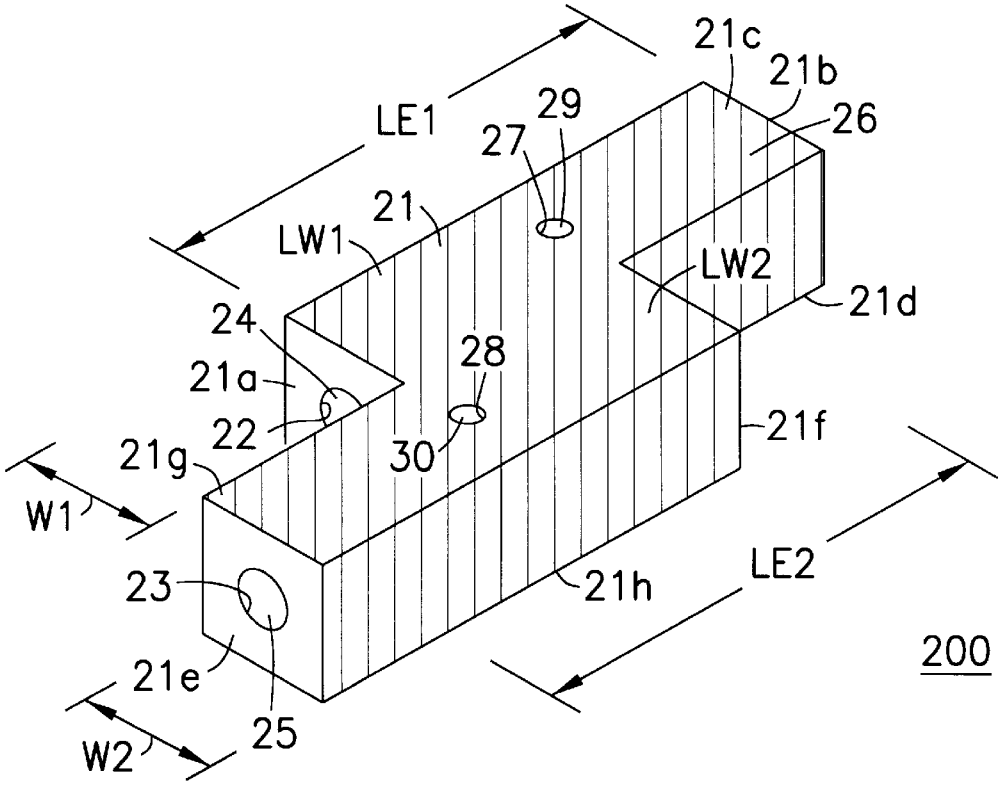
FIG. 8 is a perspective view of a second embodiment of a dielectric filter according to the present invention.
Figure 9:
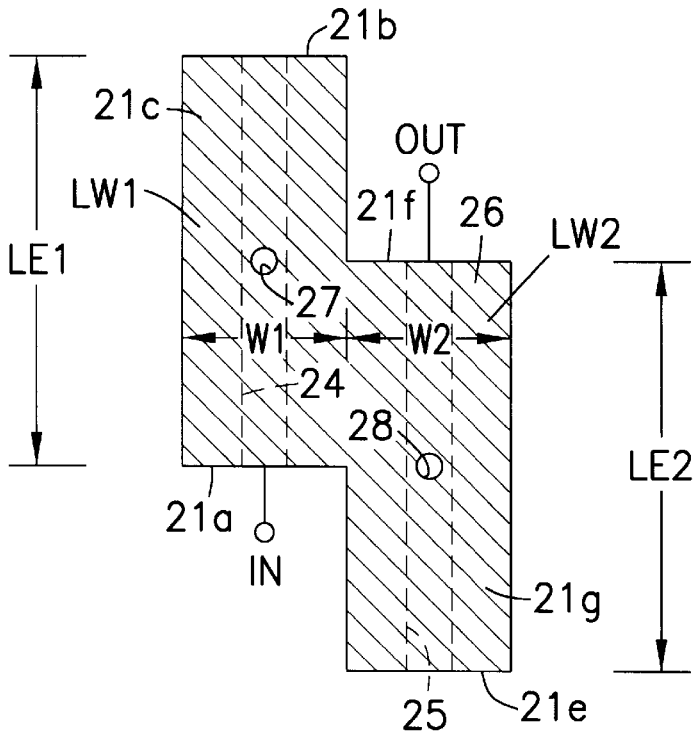
FIG. 9 is a plan view of the dielectric filter shown in FIG. 8.

FIG. 8 is a perspective view of a second embodiment of a dielectric filter 200 according to the present invention, while a plan view thereof is shown in FIG. 9. As shown in these figures, the dielectric filter is composed of a dielectric block 21 made up of a ceramic material including two sub-blocks LW1 and LW2 formed in an integral fashion. Sub-blocks LW1 and LW2 have equal lengths LE1 and LE2 and equal widths W1 and W2 wherein sub-blocks LW1 and LW2 are shifted in position along their longitudinal directions relative to each other by half the length LE1 or LE2.

The sub-block LW1 has two opposing end faces, namely a first end face 21*a* and a second end face 21*b*, located at either end of the length LE1, and also has two opposing sides, namely an upper face 21*c* and a lower face 21*d*, which are perpendicular to the end faces 21*a* and 21*b*. Similarly, the sub-block LW2 has two opposing end faces, namely a first end face 21*e* and a second end face 21*f*, located at either end of the length LE2, and also has two opposing sides, namely an upper face 21*g* and a lower face 21*h*, which are perpendicular to the end faces 21*e* and 21*f*. The first end faces 21*a* and 21*e* of the respective sub-blocks LW1 and LW2 are both located on one side of the dielectric filter 200, while the second end faces 21*b* and 21*f* are both located on the other side. The upper faces 21*c* and 21*g* of the respective sub-blocks LW1 and LW2 lie in one plane, and the lower faces 21*d* and 21*h* lie in another plane.

The dielectric block 21 has a through-hole 22 formed between the first and second end faces 21*a* and 21*b* of the sub-block LW1 and also has a through-hole 23 formed between the first and second end faces 21*e* and 21*f* of the sub-block LW2. Inner conductors 24 and 25 are formed on the inner walls of the respective through-holes 22 and 23. An outer conductor 26 is formed over the whole outer surface of the dielectric block 21 except the end faces 21*a*, 21*b*, 21*e*, and 21*f*. In this structure, the inner conductors 24 and 25 are not connected, at either end, to the outer conductor 26, and thus each of inner conductors 24 and 25 are electrically open-circuited at their ends. The inner conductors 24, 25 and the outer conductor 26 may be formed, for example, by disposing an electrode material such as Cu over the whole surface of the dielectric block 21 including the inner walls of the through-holes 22, 23 using electroless plating or the like, and then removing the electrode material from the end faces 21*a*, 21*b*, 21*e*, and 21*f*.

The dielectric block 21 has a side-wall through-hole 27 extending from a central part of the inner wall of the through-hole 22 between its two opposing ends to the upper surface 21*c* (where upper surface 21*c* is a part of the outer surface of the dielectric block 21). Dielectric block 21 also has a side-wall through-hole 28 extending from a central part of the inner wall of the through-hole 23 between its two opposing ends to the upper surface 21*g* (where upper surface 21*g* is also a part of the outer surface of the dielectric block 21). Connection conductors 29 and 30 are formed on the inner walls of the respective side-wall through-holes 27 and 28 so that the central parts of the respective inner conductors 24 and 25 between the two opposing ends are connected to the outer conductor 26 via the connection conductors 29 and 30. These connection conductors 29 and 30 may be formed at the same time as the inner conductors 24 and 25 and the outer conductor 26 by subjecting the side-wall through-holes 27 and 28 to the plating process for forming the inner conductors 24 and 25 and the outer conductor 26.

In the dielectric filter having the structure described above, the end of the inner conductor 24 on the side of the first end face 21*a* of the sub-block LW1 is used as an input terminal IN, while the end of the inner conductor 25 on the side of the second end face 21*f* of the sub-block LW2 is used as an output terminal OUT, as shown in FIG. 9. The outer conductor 26 is connected to a ground line. Thus, the dielectric filter of the present embodiment can be represented by an equivalent circuit shown in FIG. 10.

In this equivalent circuit, R3 and R4 are two resonators formed with the inner conductor 24 of the sub-block LW1 divided into two sections at the center between its two opposing ends, and R5 and R6 are two resonators formed with the inner conductor 25 of the sub-block LW2 divided into two sections at the center between its two opposing ends. L2 is an inductor associated with the connection conductor 29 of the sub-block LW1, and L3 is an inductor associated with the connection conductor 30 of the sub-block LW2. K3S is a phase shifter formed between a part of the sub-block LW1 in the region extending from the first end face 21*a* to the connection conductor 29 and a part of the sub-block LW2 in the region extending from the second end face 21*f* to the connection conductor 30.

Figure 10:
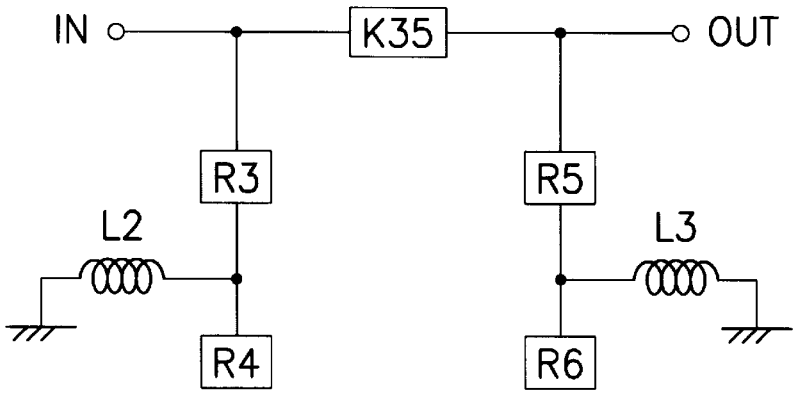
FIG. 10 is a circuit diagram of an equivalent circuit of the dielectric filter shown in FIG. 8.

As described above, the dielectric filter includes: the dielectric block 21 composed of the sub-block LW1 with two opposing end faces namely the first end face 21*a* and the second end face 21*b*, and the sub-block LW2 with two opposing end faces namely the first end face 21*e* and the second end face 21*f*; the two through-holes 22 and 23, one of which is formed between the first end face 21*a* and the second end face 21*b* of the sub-block LW1 of the dielectric block 21, while the other one is formed between the first end face 21*e* and the second end face 21*f* of the sub-block LW2; the two inner conductors 24 and 25 formed on the inner walls of the respective through-holes 22 and 23 wherein both ends of each inner conductor 24, 25 are electrically open-circuited; the outer conductor 26 formed on the outer surface of the dielectric block 21; and the two connection conductors 29 and 30 by which the central parts of the respective inner conductors 24 and 25 are connected to the output conductor 26. As shown in FIG. 10, two filter stages are formed in the dielectric filter having the above structure (a first filter stage is composed of the resonators R3 and R4 and the inductor L2 while a second filter stage is composed of the resonators R5 and R6 and the inductor L3). One filter stage is connected to the input terminal IN and the other filter stage is connected to the output terminal OUT. Furthermore, these two filter stages are connected to each other via the phase shifter K35. Therefore, in this dielectric filter having the above structure, the signal input at the input terminal IN is changed in phase by about 90° via the phase shifter K35, and thus the phase-shifted signal appears at the output terminal OUT.

Figure 11:
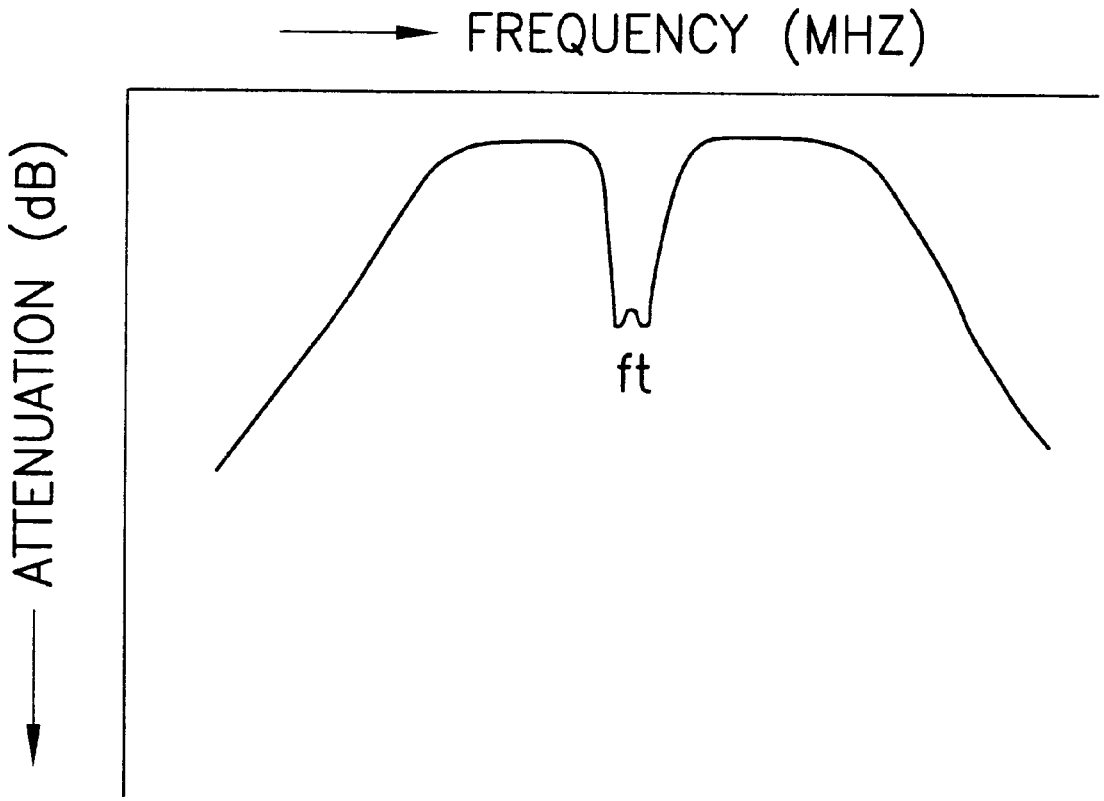
FIG. 11 is a graph illustrating the frequency characteristic of the dielectric filter shown in FIG. 8.

The dielectric filter with the above structure has two pass-bands separated by a trap frequency ft, as shown in FIG. 11, wherein attenuation occurs at the upper and lower edges of both of the pass-bands. The trap frequency ft and the frequency-attenuation characteristics of the two band-pass regions located at either side of the trap frequency ft are determined by properly selecting the relative dielectric constant of the dielectric block 21, the lengths of the inner conductors 24 and 25, and the inductances associated with the connection conductors 29 and 30. Since the dielectric filter of the present embodiment has two filter stages, it is possible to adjust the frequency bandwidth of the trap band, and a greater attenuation can be achieved within the trap band. Thus, this dielectric filter acts as a high-performance band-elimination filter having two pass-bands at either side of the trap frequency ft. In other words, the dielectric filter behaves both as a band-pass filter and a band-elimination filter.

Although not shown here in the figure, end face electrodes similar to those shown in FIGS. 5 or 6 may be formed on the end face 21*a* of the sub-block LW1 such that the end face electrode on the end face 21*a* is connected to the inner conductor 24 to serve as an input terminal IN. End face 21*f* of sub-block LW2 may be modified in the same way such that the end face electrode on the end face 21*f* is connected to the inner conductor 25 to serve as an output terminal OUT. In this case, as in the example shown in FIGS. 5 or 6, the outer conductor 26 may have additional portions which extend onto the end faces 21*a* and 21*f* and which are electrically isolated from the end face electrodes. The other end faces may be covered with portions extending from the outer conductor 26 as shown in FIG. 7. The addition of these end face electrodes readily permits a signal line to be connected to the inner conductors. That is, the connection can be accomplished simply by connecting the signal line to the respective end face electrodes serving as the input terminal IN and the output terminal OUT. Furthermore, in the case where the outer conductor 26 is formed by means of plating, the above structures having the end face electrodes allow the conductors to be more easily formed, because these structures lead to a reduction in the area of the electrode material which should be removed after the plating process.

In another alternative mode, as in the example shown in FIG. 7, the inner conductors 24 and 25 may also be formed in such a manner as to have a length which does not reach either the first end faces 21*a*, 21*e* or the second end faces 21*b*, 21*f*. In this case, the outer conductor 26 may be formed in such a manner as to have additional portions which extend over the whole area of the first end faces 21*a*, 21*e* and the second end faces 21*b*, 21*f* and which further extend into the through-holes 22 and 23. This structure leads to an improvement in the shielding performance of the dielectric filter.

In the above structures, the side-wall through-holes 27 and 28 are formed, as described above, in such a manner as to extend from the corresponding central parts of the inner walls of the through-holes 22 and 23 between their two opposing ends to the outer surface of the dielectric block 21, and the connection conductors 29 and 30 are formed on the inner walls of the respective side-wall through-holes 27 and 28 in such a manner that the central parts of the inner conductors 24 and 25 between the two opposing ends are connected to the outer conductor 26 via the connection conductors 29 and 30.

As referred to herein, the "central parts" between the two ends are not required to be located at the exact geometric centers but are allowed to be located within ranges around the exact geometric centers as long as the filter has a good frequency characteristic which obtains the objects of the invention.

As described above, the dielectric block 21 is composed of two sub-blocks LW1 and LW2 wherein the length LE1 between the first end face 21*a* and the second end face 21*b* of the sub-block LW1 is equal to the length LE2 between the first end face 21*e* and the second end face 21*f* of the sub-block LW2, and these two sub-blocks LW1 and LW2 are shifted in position in longitudinal directions by half the length LE1 or LE2 relative to each is other. However, these conditions are not restrictive, and deviations may be made to obtain a frequency characteristic similar to that shown in FIG. 11. That is, in the dielectric block 21 of the present embodiment, a certain tolerance is allowed in the degree to which the length LE1 from the first end face 21*a* to the second end face 21*b* of the sub-block LW1 matches the length LE2 from the first end face 21*e* to the second end face 21*f* of the sub-block LW2. Further, the two sub-blocks LW1 and LW2 may be shifted by half the length LE1 or LE2 relative to each other in longitudinal directions (toward the opposite end faces) within a certain tolerance. Similarly, a certain tolerance is allowed in the degree to which the widths W1 and W2 of the sub-blocks LW1 and LW2 match.

Figure 12:
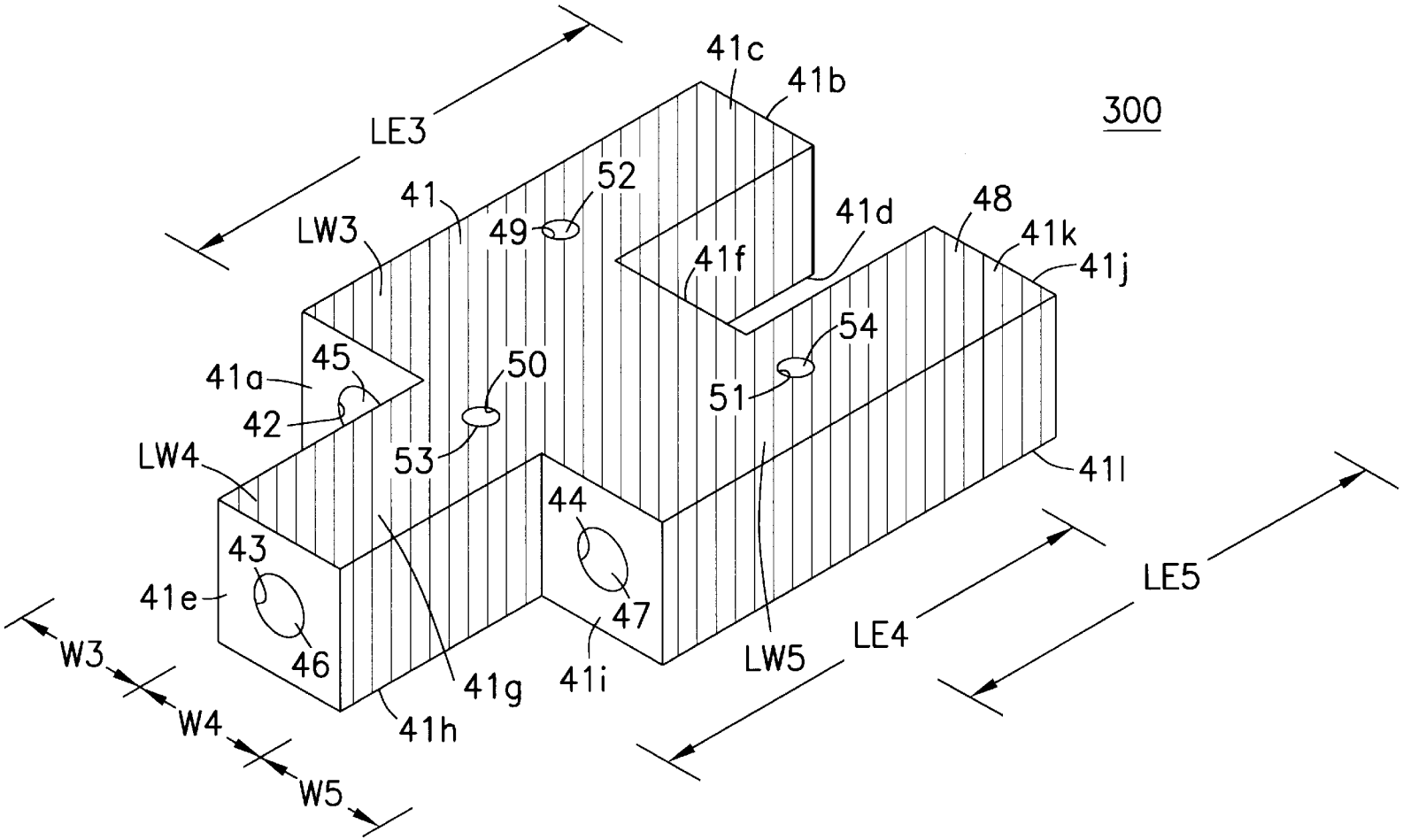
FIG. 12 is a perspective view of a third embodiment of a dielectric filter according to the present invention.
Figure 13:
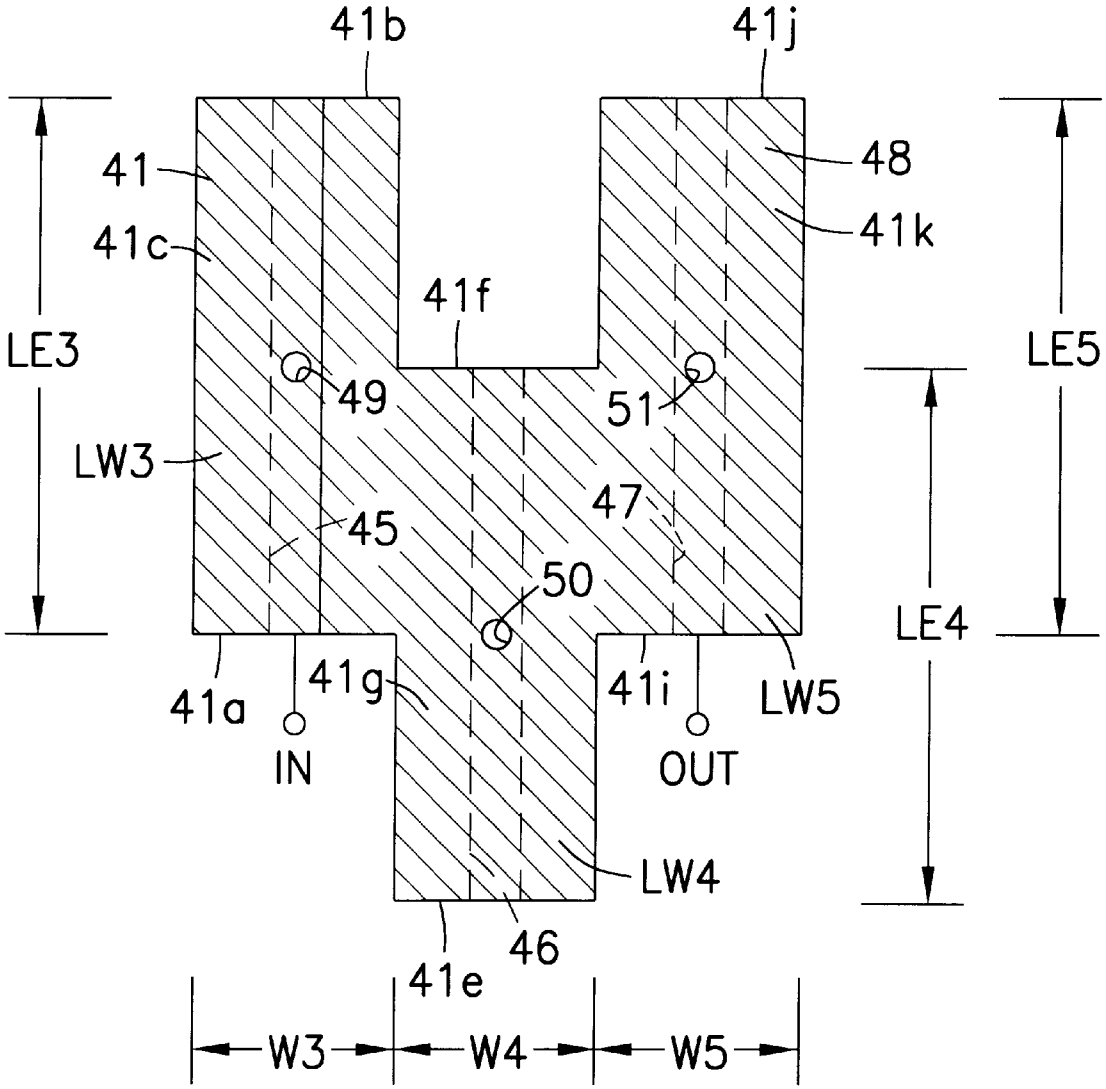
FIG. 13 is a plan view of the dielectric filter shown in FIG. 12.

FIG. 12 is a perspective view of a third embodiment of a dielectric filter 300 according to the present invention, while a plan view thereof is shown in FIG. 13. As shown in these figures, the dielectric filter is composed of a dielectric block 41 made up of a ceramic material including three sub-blocks LW3, LW4, and LW5 which are formed in an integral fashion. Sub-blocks LW3, LW4, and LW5 have equal lengths LE3, LE4, and LE5, respectively, and equal widths W3, W4, and W5, respectively. Sub-blocks LW3, LW4, and LW5 are shifted in longitudinal directions by half the length LE3, LE4, or LE5 relative to each other.

The sub-block LW3 has two opposing end faces, namely a first end face 41*a* and a second end face 41*b*, located at either end of the length LE3, and also has two opposing sides, namely an upper face 41*c* and a lower face 41*d*, which are perpendicular to the end faces 41*a* and 41*b*. Similarly, the sub-block LW4 has two opposing end faces, namely a first end face 41*e* and a second end face 41*f*, located at either end of the length LE4, and also has two opposing sides, namely an upper face 41*g* and a lower face 41*h*, which are perpendicular to the end faces 41*e* and 41*f*. The sub-block LW5 has two opposing end faces, namely a first end face 41*i* and a second end face 41*j*, located at either end of the length LE5, and also has two opposing sides, namely an upper face 41*k* and a lower face 41*l*, which are perpendicular to the end faces 41*i* and 41*j*. The first end faces 41*a*, 41*e*, and 41*i* of the respective sub-blocks LW3, LW4, and LW5 are located on a same side, while the second end faces 41*b*, 41*f*, and 41*j* are located on another same side. The sub-block LW4 located between the other two sub-blocks is shifted in the longitudinal direction by half the length LE4 relative to the sub-blocks LW3 and LW5 toward the end faces 41*a* and 41*i*. The upper faces 41*c*, 41*g*, and 41*k* of the respective sub-blocks LW3, LW4, and LW5 lie in one plane, and the lower faces 41*d*, 41*h*, and 41*l* lie in another plane.

The dielectric block 41 has through-holes 42, 43, and 44 wherein the through-hole 42 is formed between the first and second end faces 41*a* and 41*b* of the sub-block LW3, the through-hole 43 is formed between the first and second end faces 41*e* and 41*f* of the sub-block LW4, and the through-hole 44 is formed between the first and second end faces 41*i* and 41*j* of the sub-block LWS. Inner conductors 45, 46, 47 are formed on the inner walls of the respective through-holes 42, 43, and 44. An outer conductor 48 is formed over the whole outer surface of the dielectric block 41 except the end faces 41*a*, 41*b*, 41*e*, 41*f*, 41*i*, and 41*j*. In this structure, the is respective inner conductors 45, 46, and 47 are not connected, at either end, to the outer conductor 48, and thus each of inner conductors 45, 46, and 47 are electrically open-circuited at their ends. The inner conductors 45, 46, and 47 and the outer conductor 48 may be formed, for example, by disposing an electrode material such as Cu over the whole surface of the dielectric block 41 including the inner walls of the through-holes 42, 43, and 44 by means of electroless plating or the like. The electrode material is then removed from the end faces 41*a*, 41*b*, 41*e*, 41*f*, 41*i*, and 41*j*. The dielectric block 41 has side-wall through-holes 49, 50, and 51, each extending from the central parts of the inner walls of the respective through-holes 42, 43, and 44 between their opposing ends to the upper surfaces 41*c*, 41*g*, and 41*k* (where surfaces 41*e*, 41*g*, and 41*k* are parts of the outer surface of the dielectric block 41). Connection conductors 52, 53, and 54 are formed on the inner walls of the respective side-wall through-holes 49, 50, and 51 such that the central parts of the respective inner conductors 45, 46, and 47 between the two opposing ends are connected to the outer conductor 48 via the connection conductors 52, 53, and 54. These connection conductors 52, 53, and 54 may be formed at the same time as the inner conductors 45, 46, and 47 and the outer conductor 48 by subjecting the side-wall through-holes 49, 50, and 51 to the plating process for forming the inner conductors 45, 46, and 47 and the outer conductor 48.

In the dielectric filter having the structure described above, the end of the inner conductor 45 on the side of the first end face 41*a* of the sub-block LW3 of the dielectric block 41 is used as an input terminal IN, while the end of the inner conductor 47 on the side of the second end face 41*i* of the sub-block LW5 of the dielectric block 41 is used as an output terminal OUT, as shown in FIG. 13. The outer conductor 48 is connected to a ground line. Thus, the dielectric filter of the present embodiment can be represented by an equivalent circuit shown in FIG. 14.

In this equivalent circuit, R7 and R8 are two resonators formed with the inner conductor 45 divided into two sections at the center between its two ends, R9 and R10 are two resonators formed with the inner conductor 46 divided into two sections at the center between its two ends, and R11 and R12 are two resonators formed with the inner conductor 47 divided into two sections at the center between its two ends. L4 is an inductor associated with the connection conductor 52, L5 is an inductor associated with the connection conductor 53, and L6 is an inductor associated with the connection conductor 54.

K79 is a phase shifter formed between a part of K79 the sub-block LW3 of the dielectric block 41 in the region extending from the first end face 41*a* to the connection conductor 52 and a part of the sub-block LW4 in the region extending from the second end face 41*f* to the connection conductor 53. K911 is a phase shifter formed between a part of the sub-block LW4 of the dielectric block 41 in the region extending from the second end face 41*f* to the connection conductor 53 and a part of the sub-block LWS in the region extending from the first end face 41*i* to the connection conductor 54.

Figure 14:
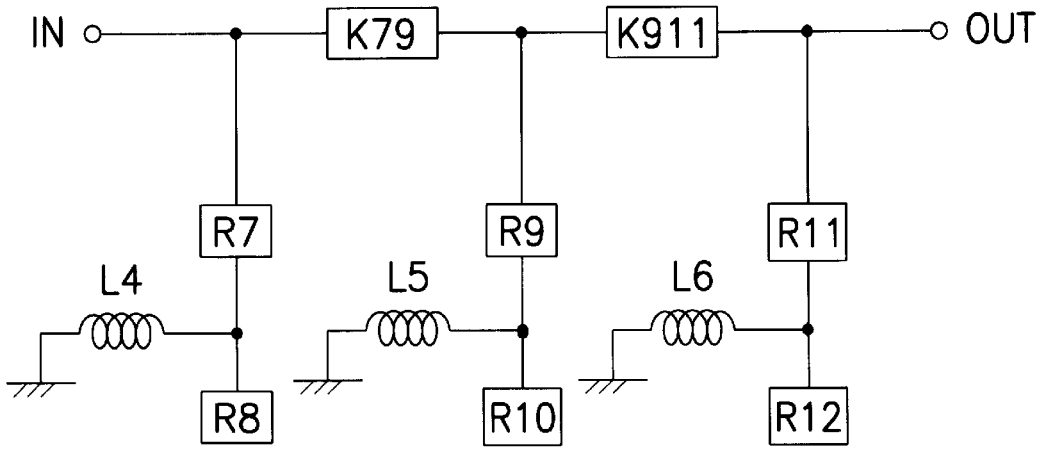
FIG. 14 is a circuit diagram of an equivalent circuit of the dielectric filter shown in FIG. 12.

As described above, the dielectric filter includes: the dielectric block 41 composed of the sub-block LW3 with two opposing end faces namely the is first end face 41*a* and the second end face 41*b*, the sub-block LW4 with two opposing end faces namely the first end face 41*e* and the second end face 41*f*, and the sub-block LW5 with two opposing end faces namely the first end face 41*i* and the second end face 41*j*. The dielectric block 41 also includes the three through-holes 42, 43, and 44 wherein the through-hole 42 is formed between the first end face 41*a* and the second end face 41*b* of the sub-block LW3 of the dielectric block 41, the through-hole 43 is formed between the first end face 41*e* and the second end face 41*f* of the sub-block LW4, and the through-hole 44 is formed between the first end face 41*i* and the second end face 41*j* of the sub-block LW5. The dielectric block 41 also includes the three inner conductors 45, 46, and 47 formed on the inner walls of the respective through-holes 42, 43, and 44 wherein both ends of each inner conductor 45, 46, 47 are electrically open-circuited; the outer conductor 48 formed on the outer surface of the dielectric block 41; and the three connection conductors 52, 53, and 54 by which the central parts of the respective inner conductors 45, 46, and 47 are connected to the output conductor 48. As shown in FIG. 14, three filter stages are formed in the dielectric filter having the above structure (a first filter stage is composed of the resonators R7 and R8 and the inductor L4, a second filter stage is composed of the resonators R9 and R10 and the inductor L5, and a third filter stage is composed of the resonators R11 and R12 and the inductor L6). These three filter stages are connected from one stage to the next via the phase shifters K79, and K911. The filter stage including the resonator R9 is connected to the input terminal IN and the filter stage including the resonator R11 is connected to the output terminal OUT. Therefore, in this dielectric filter having the above structure, the signal given at the input terminal IN is changed in phase by about 90° via the phase shifter K79 and by another 90° via the phase shifter K911 and the phase-shifted signal appears at the output terminal OUT.

Figure 15:
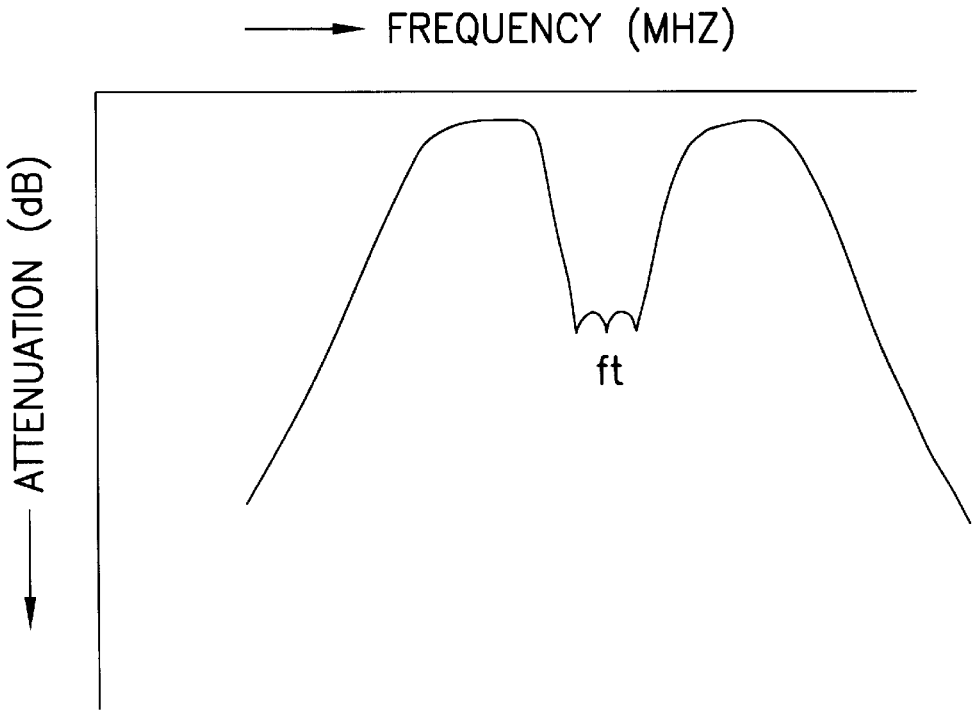
FIG. 15 is a graph illustrating the frequency characteristic of the dielectric filter shown in FIG. 12.

The dielectric filter with the above structure has two pass-bands separated by a trap frequency ft, as shown in FIG. 15, wherein attenuation occurs at edges of the pass-bands. The trap frequency ft and the frequency-attenuation characteristics of the two pass-bands located at either side of the trap frequency ft are determined by properly selecting the relative dielectric constant of the dielectric block 41, the lengths of the inner conductors 45, 46, and 47, and the inductances associated with the connection conductors 52, 53, and 54. Since the dielectric filter of the present embodiment has three filter stages, it is possible to adjust the frequency bandwidth of the trap band, and a greater attenuation can be achieved within the trap band. Thus, this dielectric filter acts as a high-performance band-elimination filter having two pass-bands at either side of the trap frequency ft. In other words, the dielectric filter behaves both as a band-pass filter and a band-elimination filter.

Although not shown here in the figure, end face electrodes similar to those shown in FIG. 5 or 6 may be formed on the end face 41*a* of the sub-block LW3 and the end face 41*i* of the sub-block LW5 such that the end face electrode on the end face 41*a* is connected to the inner conductor 45 to serve as an input terminal IN and the end face electrode on the end face 41*i* is connected to the inner conductor 47 to serve as an output terminal OUT. In this case, as in the example shown in FIGS. 5 or 6, the outer conductor 48 may have additional portions which extend on the end faces 41*a* and 41*i* and which are electrically isolated from the end face electrodes. The other end faces may be covered with portions extending from the outer conductor 48 as in the example shown in FIG. 7. The addition of these end face electrodes readily permits a signal line to be connected to the inner conductors. That is, the connection can be accomplished simply by connecting the signal line to the respective end face electrodes serving as the input terminal IN and the output terminal OUT. Furthermore, in the case where the outer conductor 48 is formed by means of plating, the above structures having the end face electrodes allow the conductors to be more easily formed, because these structures lead to a reduction in the area of the electrode material which should be removed after the plating process.

In an alternative mode, the inner conductors 45, 46, and 47 may also be formed in such a manner as to have a length which does not reach either the first end faces 41*a*, 41*e*, 41*i* or the second end faces 41*b*, 41*f*, 41*j*. In this case, the outer conductor 48 may be formed in such a manner as to have additional portions which extend over the whole areas of the first end faces 41*a*, 41*e*, 41*i* and the second end faces 41*b*, 41*f*, 41*j* and which further extend into the through-holes 42, 43, and 44. This structure leads to an improvement in the shielding performance of the dielectric filter.

In the above structures, the side-wall through-holes 49, 50, and 51 are formed, as described above, in such a manner as to extend from the corresponding central parts of the inner walls of the respective through-holes 42, 43, and 44 (between their two opposing ends) to the outer surface of the dielectric block 41. The connection conductors 52, 53, and 54 are formed on the inner walls of the respective side-wall through-holes 49, 50, and 51 in such a manner that the central parts of the inner conductors 45, 46, and 47 between the two opposing ends are connected to the outer conductor 48 via the connection conductors 52, 53, and 54. Herein the central parts between the two ends need not necessarily be located at the exact geometric centers but may to be located within ranges around the exact geometric centers as long as the filter has a good frequency characteristic as described herein, for example in FIG. 15.

In the dielectric block 41, as described above, the length LE3 between the first end face 41*a* and the second end face 41*b* of the sub-block LW3, the length LE4 between the first end face 41*e* and the second end face 41*f* of the sub-block LW4, and the length LES between the first end face 41*i* and the second end face 41*j* of the sub-block LWS are equal to one another. Further, the three sub-blocks LW3, LW4, and LW5 are shifted in longitudinal directions by half the length of one sub-block relative to adjacent sub-blocks. However, these conditions are not restrictive, and some deviations are permitted to obtain a frequency characteristic similar to that shown in FIG. 15. That is, in the dielectric block 41 of the present embodiment, a certain tolerance is allowed in the degree to which the length LE3, LE4, and LES match. Further, the three sub-blocks LW3, LW4, and LWS may be shifted in longitudinal directions (toward the opposite end face) by half the is length of one sub-block relative to the adjacent sub-block within a certain tolerance. Similarly, a certain tolerance is allowed in the degree to which the widths W3, W4, and W5 of the sub-blocks LW3, LW4, and LW5 match.

Figure 16:
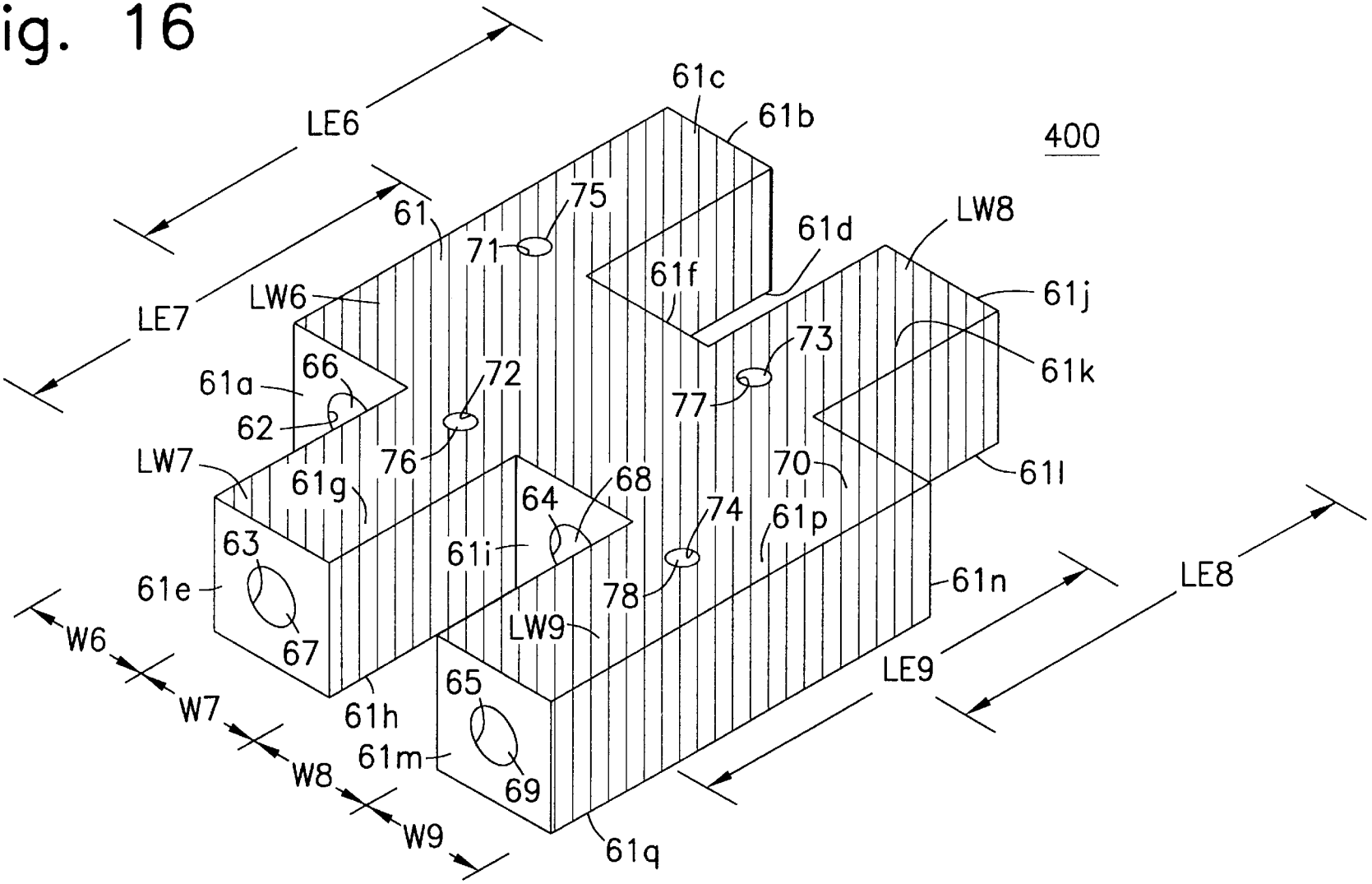
FIG. 16 is a perspective view of a fourth embodiment of a dielectric filter according to the present invention.
Figure 17:
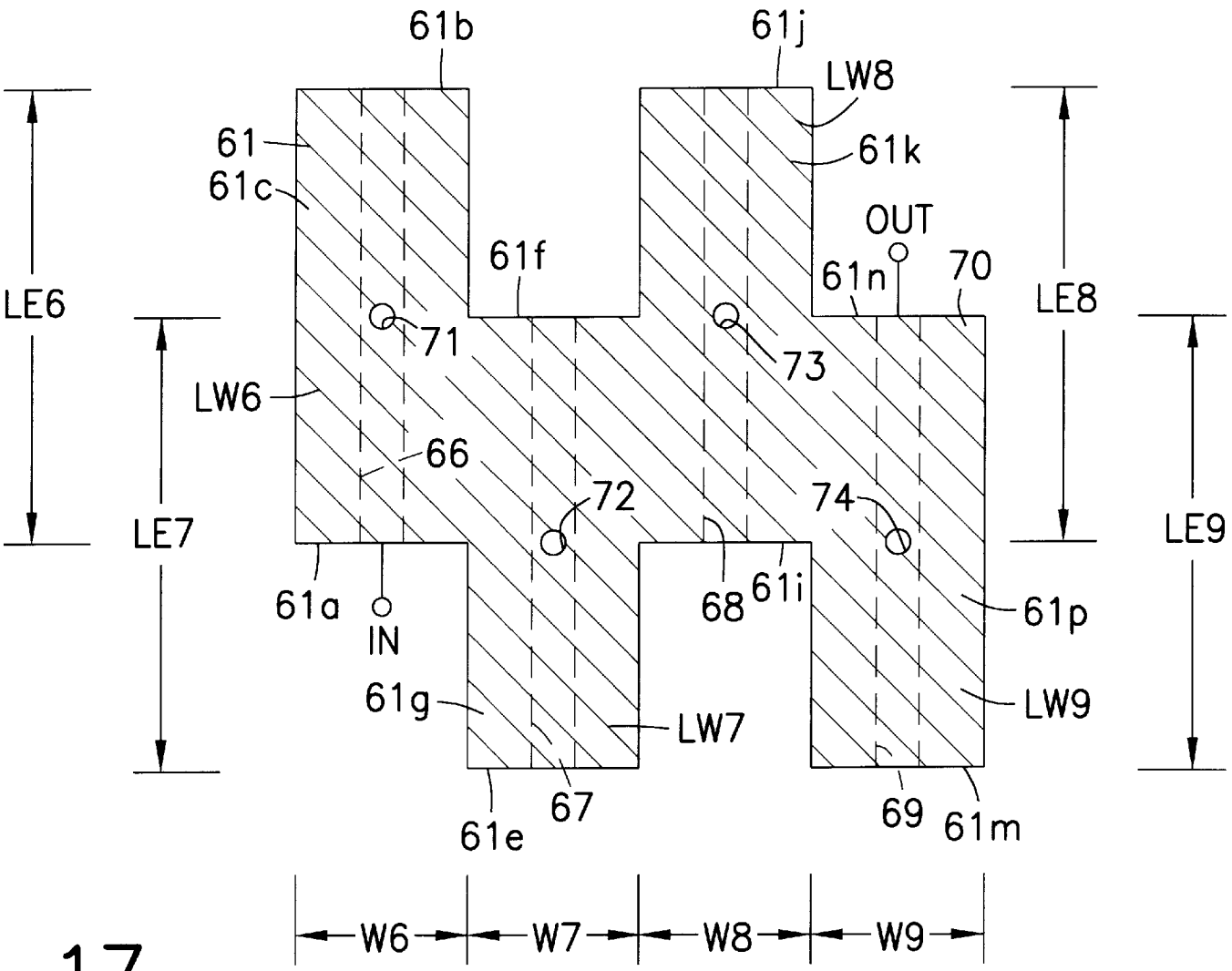
FIG. 17 is a plan view of the dielectric filter shown in FIG. 16.

FIG. 16 is a perspective view of a fourth embodiment of a dielectric filter 400 according to the present invention, while a plan view thereof is shown in FIG. 17. As shown in these figures, the dielectric filter is composed of a dielectric block 61 made up of a ceramic material including four sub-blocks LW6, LW7, LW8, and LW9 formed in an integral fashion and having equal lengths LE6, LE7, LE8, and LE9 and equal widths W6, W7, W8, and W9. The four sub-blocks LW6, LW7, LW8 and LW9 are shifted in longitudinal directions by half the length LE6, LE7, LE8, or LE9 relative to adjacent sub-blocks.

The sub-block LW6 has two opposing end faces, namely a first end face 61*a* and a second end face 61*b*, located at either end of the length LE6, and also has two opposing sides, namely an upper face 61*c* and a lower face 61*d* which are perpendicular to the end faces 61*a* and 61*b*. The sub-block LW7 has two opposing end faces, namely a first end face 61*e* and a second end face 61*f* located at either end of the length LE7, and also has two opposing sides, namely an upper face 61*e* and a lower face 61*f* which are perpendicular to the end faces 61*e* and 61*f*. The sub-block LW8 has two opposing end faces, namely a first end face 61*i* and a second end face 61*j*, located at either end of the length LE8, and also has two opposing sides, namely an upper face 61*k* and a lower face 61*l* which are perpendicular to the end faces 61*i* and 61*j*. The sub-block LW9 has two opposing end faces, namely a first end face 61*m* and a second end face 61*n*, located at either end of the length LE9, and also has two opposing sides, namely an upper face 61*p* and a lower face 61*q* which are perpendicular to the end faces 61*m* and 61*n*. The first end faces 61*a*, 61*e*, 61*i*, and 61*m* of the respective sub-blocks LW6, LW7, LW8, and LW9 are located on a same side, while the second end faces 61*b*, 61*f*, 61*j*, and 61*n* are located on another same side. The sub-blocks LW7 and LW9 are shifted in the longitudinal direction by half the length LE7 or LE9 relative to the sub-blocks LW6 and LW8 toward the first end faces 61*a* and 61*i*. The upper faces 61*c*,

61*g*, 61*k*, and 61*p* of the respective sub-blocks LW6, LW7, LW8, and LW9 lie in one plane, and the lower faces 61*d*, 61*h*, 61*l*, and 61*q* lie in another plane.

The dielectric block 61 has through-holes 62, 63, 64, and 65 wherein the through-hole 62 is formed between the first and second end faces 61*a* and 61*b* of the sub-block LW6, the through-hole 63 is formed between the first and second end faces 61*e* and 61*f* of the sub-block LW7, the through-hole 64 is formed between the first and second end faces 61*i* and 61*j* of the sub-block LW8, and the through-hole 65 is formed between the first and second end faces 61*m* and 61*n* of the sub-block LW9. Inner conductors 66, 67, 68, and 69 are formed on the inner walls of the respective through-holes 62, 63, 64, and 65. An outer conductor 70 is formed over the whole outer surface of the dielectric block 61 except the end faces 61*a*, 61*b*, 61*e*, 61*f*, 61*i*, 61*j*, 61*m*, and 61*n*. In this structure, the respective inner conductors 66, 67, 68, and 69 are not connected, at either end, to the outer conductor 70, and thus the inner conductors 66, 67, 68, and 69 are electrically open-circuited. The inner conductors 66, 67, 68, and 69 and the outer conductor 70 is may be formed, for example, by disposing an electrode material such as Cu over the whole surface of the dielectric block 61 including the inner walls of the through-holes 62, 63, 64, and 65 by means of electroless plating or the like. The electrode material is then removed from the end faces 61*a*, 61*b*, 61*e*, 61*f*, 61*i*, 61*j*, 61*m*, and 61*n*.

The dielectric block 61 has respective side-wall through-holes 71, 72, 73, and 74 extending from the central parts of the inner walls of the respective through-holes 62, 63, 64, and 65 (between their two ends) to the upper surfaces 61*c*, 61*g*, 61*k*, and 61*p* (where upper surfaces 61*c*, 61*g*, 61*k* and 61*p* are parts of the outer surface of the dielectric block 61). Connection conductors 75, 76, 77, and 78 are formed on the inner walls of the respective side-wall through-holes 71, 72, 73, and 74 so that the central parts of the respective inner conductors 66, 67, 68, and 69 between the corresponding two ends are connected to the outer conductor 70 via the connection conductors 75, 76, 77, and 78. These connection conductors 75, 76, 77, and 78 may be formed at the same time as the inner conductors 66, 67, 68, and 69 and the outer conductor 70 by subjecting the side-wall through-holes 71, 72, 73, and 74 to the plating process for forming the inner conductors 66, 67, 68, and 69 and the outer conductor 70.

In the dielectric filter having the structure described above, the end of the inner conductor 66 on the side of the first end face 61*a* of the sub-block LW6 of the dielectric block 61 is used as an input terminal IN, while the end of the inner conductor 69 on the side of the second end face 61*n* of the sub-block LW9 of the dielectric block 61 is used as an output terminal OUT, as shown in FIG. 17. The outer conductor 70 is connected to a ground line. Thus, the dielectric filter of the present embodiment can be represented by an equivalent circuit shown in FIG. 18.

In this equivalent circuit, R13 and R14 are two resonators formed with the inner conductor 66 divided into two sections at the center between its two opposing ends, R15 and R16 are two resonators formed with the inner conductor 67 divided into two sections at the center between its two opposing ends, R17 and R18 are two resonators formed with the inner conductor 68 divided into two sections at the center between its two opposing ends, and R19 and R20 are two resonators formed with the inner conductor 69 divided into two sections at the center between its two opposing ends. L7 is an inductor associated with the connection conductor 75, L8 is an inductor associated with the connection conductor 76, L9 is an inductor associated with the connection conductor 77, and L10 is an inductor associated with the connection conductor 78.

K1315 is a phase shifter formed between a part of the sub-block LW6 of the dielectric block 61 in the region extending from the first end face 61*a* to the connection conductor 75 and a part of the sub-block LW7 in the region extending from the second end face 61*f* to the connection conductor 76. K1517 is a phase shifter formed between a part of the sub-block LW7 in the region extending from the second end face 61*f* to the connection conductor 76 and a part of the sub-block LW8 in the region extending from the first end face 61*i* to the connection conductor 77. K1719 is a phase shifter formed between a part of the sub-block LW8 in the region extending from the first end face 61*i* to the connection conductor 77 and a part of the sub-block LW9 in the region extending from the second end face 61*n* to the connection conductor 78.

As described above, the dielectric filter includes: the dielectric block 61 composed of the sub-block LW6 with two opposing end faces namely the first end face 61*a* and the second end face 61*b*, the sub-block LW7 with two opposing end faces namely the first end face 61*e* and the second end face 61*f*, the sub-block LW8 with two opposing end faces namely the first end face 61*i* and the second end face 61*j*, and the sub-block LW9 with two opposing end faces namely the first end face 61*m* and the second end face 61*n*. The dielectric block 61 also includes the four through-holes 62, 63, 64, and 65 wherein the through-hole 62 is formed between the first end face 61*a* and the second end face 61*b* of the sub-block LW6 of the dielectric block 61, the through-hole 63 is formed between the first end face 61*e* and the second end face 61*f* of the sub-block LW7, the through-hole 64 is formed between the first end face 61*i* and the second end face 61*j* of the sub-block LW8, and the through-hole 65 is formed between the first end face 61*m* and the second end face 61*n* of the sub-block LW9. The dielectric block 61 also includes the four inner conductors 66, 67, 68, and 69 formed on the inner walls of the respective through-holes 62, 63, 64, and 65 wherein both ends of each inner conductor 66, 67, 68, and 69 are electrically open-circuited. The dielectric block 61 also includes the outer conductor 70 formed on the outer surface of the dielectric block 61; and the four connection conductors 75, 76, 77, and 78 by which the central parts of the respective inner conductors 66, 67, 68, and 69 are connected to the output conductor 70.

Figure 18:
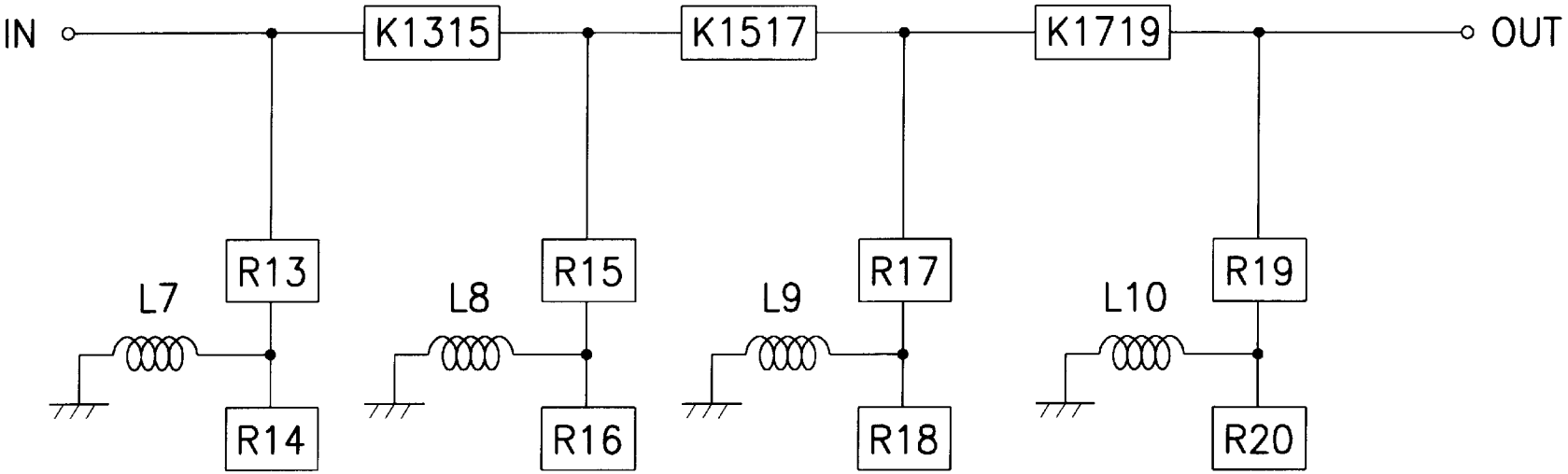
FIG. 18 is a circuit diagram of an equivalent circuit of the dielectric filter shown in FIG. 16.

As shown in FIG. 18, four filter stages are formed in the dielectric filter having the above structure (a first filter stage is composed of the resonators R13 and R14 and the inductor L7, a second filter stage is composed of the resonators R15 and R16 and the inductor L8, a third filter stage is composed of the resonators R17 and R18 and the inductor L9, and a fourth filter stage is composed of the resonators R19 and R20 and the inductor L10). These four filter stages are coupled from one stage to a following stage via the respective phase shifters K1315, K1517, and K1719. The filter stage including the resonator R13 is connected to the input terminal IN and the filter stage including the resonator R19 is connected to the output terminal OUT. Therefore, in this dielectric filter having the above structure, the signal input at the input terminal IN is changed in phase by about 90° via each phase shifter K1315, K1517, K1719, and the phase-shifted signal appears at the output terminal OUT.

Figure 19:
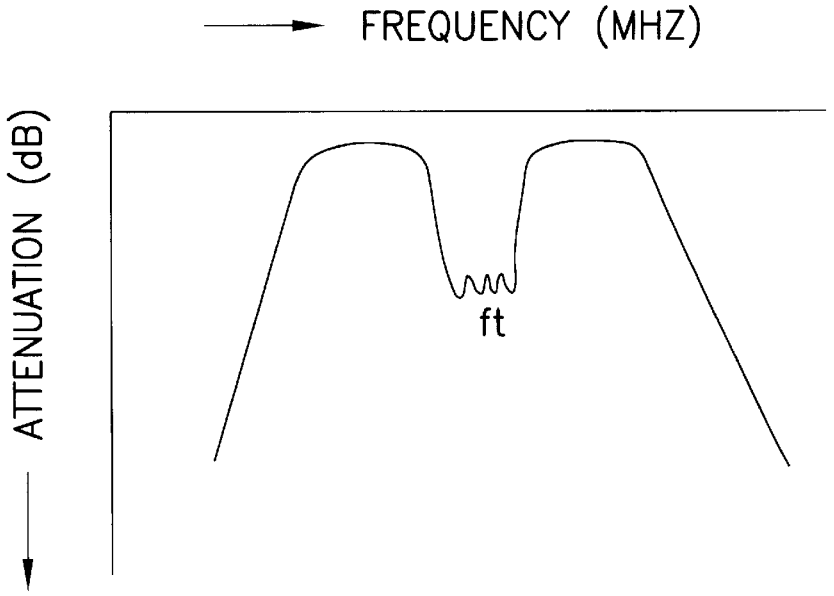
FIG. 19 is a graph illustrating the frequency characteristic of the dielectric filter shown in FIG. 16.

The dielectric filter with the above structure has two pass-bands separated by a trap frequency ft, as shown in FIG. 19, wherein attenuation occurs at both edges of the two pass-bands. The trap frequency ft and the frequency characteristics of the two pass-bands located at either side of the trap frequency ft are determined by properly selecting the relative dielectric constant of the dielectric block 61, the lengths of the inner conductors 66, 67, 68, and 69, and the inductances associated with the connection conductors 75, 76, 77, and 78. Since the dielectric filter of the present embodiment has four filter stages, it is possible to adjust the frequency bandwidth of the trap band, and a greater attenuation can be achieved within the trap band. Thus, this dielectric filter acts as a high-performance band-elimination filter having two pass-bands at either side of the trap frequency ft. In other words, the dielectric filter behaves both as a band-pass filter and a band-elimination filter.

Although not shown here in the figure, end face electrodes similar to those shown in FIGS. 5 or 6 may be formed on the first end face 61*a* of the sub-block LW6 and the second end face 61*n* of the sub-block LW9 such that the end face electrode on the first end face 61*a* is connected to the inner conductor 66 to serve as an input terminal IN and the end face electrode on the second end face 61*n* is connected to the inner conductor 69 to serve as an output terminal OUT. In this case, as in the example shown in FIGS. 5 or 6, the outer conductor 70 may have additional portions which extend on the first end face 61*a* and the second end face 61*n* and which are electrically isolated from the end face electrodes. The other end faces may be covered with conductors extending from the outer conductor 70 as in the example shown in FIG. 7. The addition of these end face electrodes readily permits a signal line be connected to the inner conductors. That is, the connection can be accomplished simply by connecting the signal line to the respective end face electrodes serving as the input terminal IN and the output terminal OUT. Furthermore, in the case where the outer conductor 70 is formed by means of plating, the above structures having the end face electrodes allow the conductors to be more easily formed, because these structures lead to a reduction in the area of the electrode material which should be removed after the plating process.

In an alternative mode, as in the example shown in FIG. 7, the inner conductors 66, 67, 68, and 69 may also be formed in such a manner as to have a length which does not reach either the first end faces 61*a*, 61*e*, 61*i*, 61*m* or the second end faces 61*b*, 61*f*, 61*j*, 61*n*. In this case, the outer conductor 70 may be formed in such a manner as to have additional portions which extend over the whole areas of the first end faces 61*a*, 61*e*, 61*i*, 61*m* and the second end faces 61*b*, 61*f*, 61*j*, 61*n* and which further extend into the through-holes 62, 63, 64, 65. This structure leads to an improvement in the shielding performance of the dielectric filter.

In the above structures, the respective side-wall through-holes 71, 72, 73 and 74 are formed, as described above, in such a manner as to extend from the corresponding central parts of the inner walls of the through-holes 62, 63, 64 and 65 (between their two opposing ends) to the outer surface of the dielectric block 61. The connection conductors 75, 76, 77 and 78 are formed on the inner walls of the respective side-wall through-holes 71, 72, 73 and 74 in such a manner that the central parts of the inner conductors 66, 67, 68 and 69 (between the two opposing ends) are connected to the outer conductor 70 via the connection conductors 75, 76, 77 and 78. Herein the central parts between the two ends do not necessarily need to be located at the exact geometric centers but are permitted to be located within ranges around the exact geometric centers as long as the filter has a good frequency characteristic, such as that shown in FIG. 19.

In the dielectric block 61, as described above, the length LE6 between the first end face 61*a* and the is second end face 61*b* of the sub-block LW6, the length LE7 between the first end face 61*e* and the second end face 61*f* of the sub-block LW7, the length LE8 between the first end face 61*i* and the second end face 61*j* of the sub-block LW8, and the length LE9 between the first end face 61*m* and the second end face 61*n* of the sub-block LW9 are equal to one another. The four sub-blocks LW6, LW7, LW8, and LW9 are shifted in position from one another in longitudinal directions by half the length of one sub-block. However, these conditions are not restrictive and some deviations are allowed to obtain a frequency characteristic similar to that shown in FIG. 19. That is, in the dielectric block 61 of the present embodiment, a certain tolerance is allowed in the degree to which the length LE6 between the first end face 61*a* and the second end face 61*b* of the sub-block LW6, the length LE7 between the first end face 61*e* and the second end face 61*f* of the sub-block LW7, the length LE8 between the first end face 61*i* and the second end face 61*j* of the sub-block LW8, and the length LE9 between the first end face 61*m* and the second end face 61*n* of the sub-block LW9 match one another. Further, the three sub-blocks LW3, LW4, and LW5 may be shifted in longitudinal directions (toward the opposite end face) by half the length of one sub-block relative to the adjacent sub-block within a certain tolerance. Similarly, the degree to which the widths W6, W7, W8, and W9 of the sub-blocks LW6, LW7, LW8, and LW9 match may have a certain tolerance.

Figure 20:
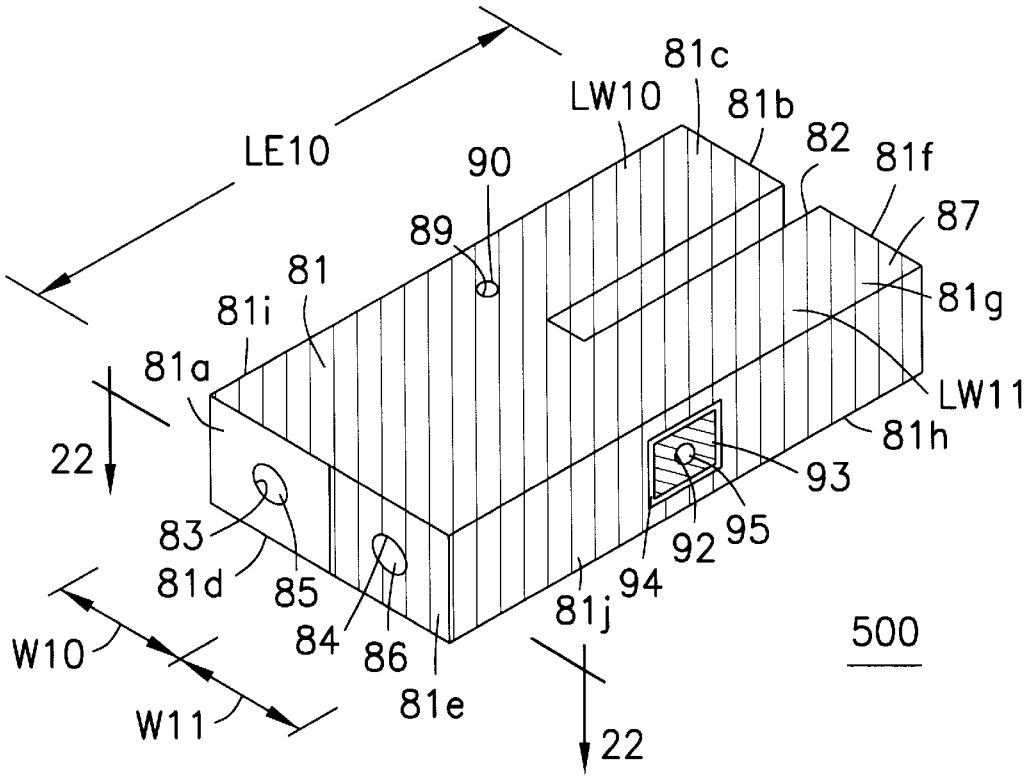
FIG. 20 is a perspective view of a fifth embodiment of a dielectric filter according to the present invention.
Figure 21:
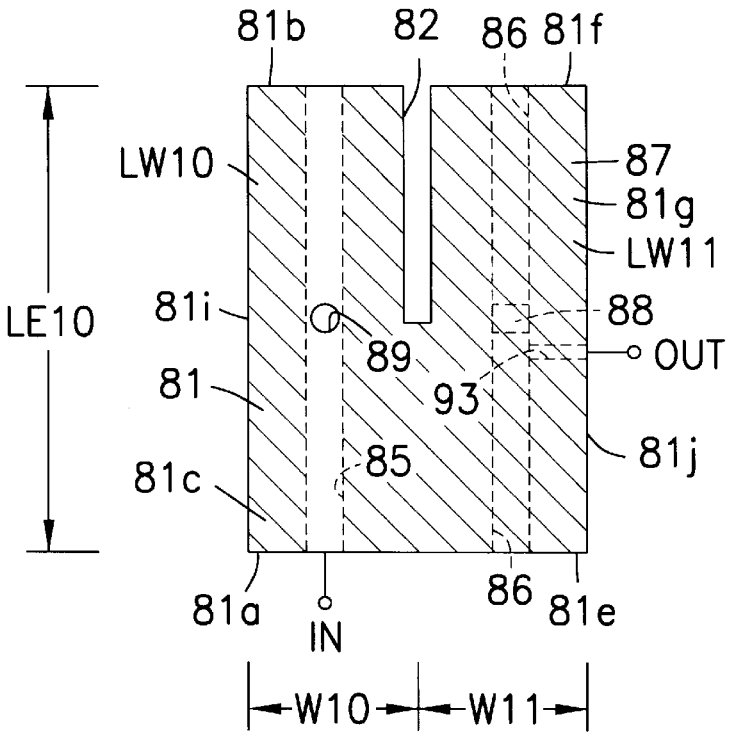
FIG. 21 is a plan view of the dielectric filter shown in FIG. 20.
Figure 22:
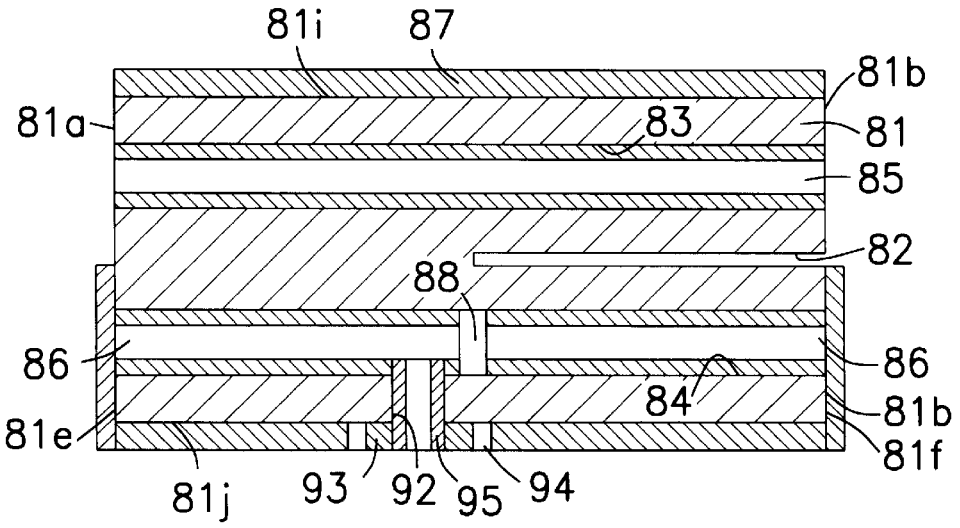
FIG. 22 is a cross-sectional view of the dielectric filter of FIG. 20 taken along line 22—22.

FIG. 20 is a perspective view of a fifth embodiment of a dielectric filter 500 according to the present invention. A plan view of FIG. 20 is shown in FIG. 21. FIG. 22 is a cross-sectional view taken along line 22—22 of FIG. 20. As shown in these figures, the dielectric filter is composed of a rectangular dielectric block 81 of a ceramic material, including a first sub-block LW10 and a second sub-block LW11 having equal lengths LE10 and equal widths W10 and W11, respectively, wherein the first and second sub-blocks are formed in an integral fashion. A slit 82 with a length equal to half the length LE10 is formed between the sub-blocks LW10 and LW11 in such a manner that the slit 82 extends from one end face toward the central part of the dielectric block 81. This slit 82 serves as a coupling preventing means for preventing electromagnetic coupling between the sub-blocks LW10 and LW11.

The first sub-block LW10 has two opposing end faces, namely a first end face 81*a* and a second end face 81*b*, located at either end of the length LE10, and also has two opposing sides, namely an upper face 81*c* and a lower face 81*d*, which are perpendicular to the end faces 81*a* and 81*b*. The second sub-block LW11 has two opposing end faces, a first end face 81*e* and a second end face 81*f*, located at either end of the length LE10, and also has two opposing sides, an upper face 81*g* and a lower face 81*h*, which are perpendicular to the end faces 81*e* and 81*f*. The first end faces 81*a* and 81*e* of the respective sub-blocks LW10 and LW11 are located on a same side and lie in one plane, while the second end faces 81*b* and 81*f* are located on an opposite same side and lie in another plane. The slit 82 is formed between these two sub-blocks LW10 and LW11 such that it extends from the second end faces 81*b* and 81*f* to the central part between the first and second end faces. The upper faces 81*c* and 81*g* of the respective sub-blocks LW10 and LW11 lie in one plane, and the lower faces 81*d* and 81*h* lie in another plane. The first sub-block LW10 has a side face 81*i*, and the second sub-block LW11 has a side face 81*j*, opposite to the side face 81*i*.

The dielectric block 81 has through-holes 83 and 84 wherein the through-hole 83 is formed between the first end face 81*a* and the second end face 81*b* of the first sub-block LW10, and the through-hole 84 is formed between the first end face 81*e* and the second end face 81*f* of the second sub-block LW11. The inner walls of the through-holes 83 and 84 are covered with inner conductors 85 and 86, respectively. An outer conductor 87 is formed over the whole outer surface of the dielectric block 81 except for the end faces 81*a* and 81*b* of the first sub-block LW10 and except for a terminal electrode of the second sub-block LW11 which will be described in further detail later. Neither end of the inner conductor 85 of the first sub-block LW10 is connected to the outer conductor 87 and thus the inner conductor 85 is electrically open-circuited at both ends. On the other hand, both ends of the inner conductor 86 of the second sub-block LW11 are connected to the outer conductor 87 and thus the inner conductor 86 is electrically short-circuited at both ends. The inner conductor 86 of the second sub-block LW11 has a gap 88 at a central part between the two outer opposing ends 81*e*, 81*f*, wherein open-circuited inner ends thereof are formed at the gap 88. A capacitor is formed by the two facing inner ends across the gap 88.

The inner conductors 85, 86 and the outer conductor 87 may be formed, for example, from an electrode material such as Cu covering the whole surface of the dielectric block 81 including the inner walls of the slit 82 and the through-holes 83 and 84 by means of electroless plating or the like, which is then removed from the end faces 81*a* and 81*b* of the first sub-block LW10. The gap area at the open-circuited inner ends 88 of the inner conductor 86 of the second sub-block LW11 is preferably covered with a protection material before starting the plating process so that no electrode material is deposited on the gap area during the plating process. Alternatively, the gap at the open-circuited inner ends 88 may be formed by partially removing the electrode material after depositing the electrode material over the whole inner wall of the through-hole 84.

The dielectric block 81 has a side-wall through-hole 89 extending from the central part between the two opposing ends of the inner wall of the through-hole 83 of the first sub-block LW11 to the upper face 81*c* of the first sub-block LW11, wherein the upper face 81*c* is a part of the outer surface of the dielectric block 81. The inner wall of the side-wall through-hole 89 is covered with a connection conductor 90 by which the central part between the two opposing ends of the inner conductor 85 is connected to the outer conductor 87. The connection conductor 90 may be formed at the same time as the inner conductors 85 and 86 by subjecting the side-wall through-hole 89 to the plating process when forming the inner conductors 85 and 86 and the outer conductor 87.

The dielectric block 81 also has a side-wall through-hole 92 extending, from a location slightly shifted from a center position toward the first end face 81*e* of the inner wall of the through-hole 84 of the second block LW11, to side face 81*j* of the second sub-block LW11, wherein the side face 81*j* is a part of the outer surface of the dielectric block 81. A terminal electrode 93 is formed on the side face 81*j*, in an area around the side-wall through-hole 92. A gap 94 is formed around the terminal electrode 93 so that the terminal electrode 93 is electrically isolated from the outer conductor 87. The inner wall of the side-wall through-hole 92 is covered with a connection conductor 95 so that the terminal electrode 93 is connected via the connection conductor 95 to the part of the inner conductor 86 at the location slightly shifted from the open-circuited inner ends 88 toward the first end face 81*e*. The terminal electrode 93 may be obtained, for example, by partially removing the outer conductor 87 to form the gap 94. The connection conductor 93 may be formed, for example, by subjecting the inner wall of the side-wall through-hole 92 to the plating process when forming the inner conductors 85 and 86 and the outer conductor 87.

In the dielectric filter having the structure described above, the end of the inner conductor 85 on the side of the first end face 81*a* of the first sub-block LW10 is used as an input terminal IN, while the terminal electrode 93 formed on the second block LW11 is used as an output terminal OUT, as shown in FIG. 21. The outer conductor 87 is connected to a ground line. Thus, the dielectric filter of the present embodiment can be represented by an equivalent circuit shown in FIG. 23.

In this equivalent circuit, R21 and R22 are two resonators formed with the inner conductor 85 of the first sub-block LW10, the inner conductor 85 being divided into two sections at the center between the two ends. R23 is a resonator formed from a part of inner conductor 86 of the second sub-block LW11, extending from the second end face 81*f* to the open-circuited inner gap 88. R24 is a resonator formed from the other part of inner conductor 86 extending from the first end face 81*e* to the inner end connected to the connection conductor 95. L11 is an inductor associated with the connection conductor 90. C1 is a capacitor formed between the open-circuited inner ends of the inner conductor 86 at the gap 88. K2124 is a phase shifter formed between a part of the first sub-block LW10 of the dielectric block 81 extending from the first end face 81*a* to the connection conductor 90, and a part of the second sub-block LW11 of the dielectric block 81 extending from the first end face 81*e* to the connection conductor 95.

As described above, the dielectric filter of the present embodiment includes: the dielectric block 81 composed of the first sub-block LW10 having two opposing end faces, namely the first end face 81*a* and the second end face 81*b*, and the second sub-block LW11 having two opposing end faces, namely the first end face 81*e* and the second end face 81*f*; the through-hole 83 formed between the first end face 81*a* and the second end face 81*b* of the first sub-block LW10 of the dielectric block 81; the inner conductor 85 formed on the inner wall of the through-hole 83, wherein both ends of the inner conductor 85 are electrically open-circuited; the outer conductor 87 formed on the outer surface of the dielectric block 81; the connection conductor 90 connecting the central part of the inner conductor 85 to the outer conductor 87; the through-hole 84 formed between the first end face 81*e* and the second end face 81*f* of the second sub-block LW11 of the dielectric block 81; and the inner conductor 86 formed on the inner wall of the through-hole 84, wherein both outer ends of the inner conductor 86 are electrically short-circuited and the open-circuited inner ends 88 are formed at the center of the inner conductor 86 at the gap 88.

Figure 23:
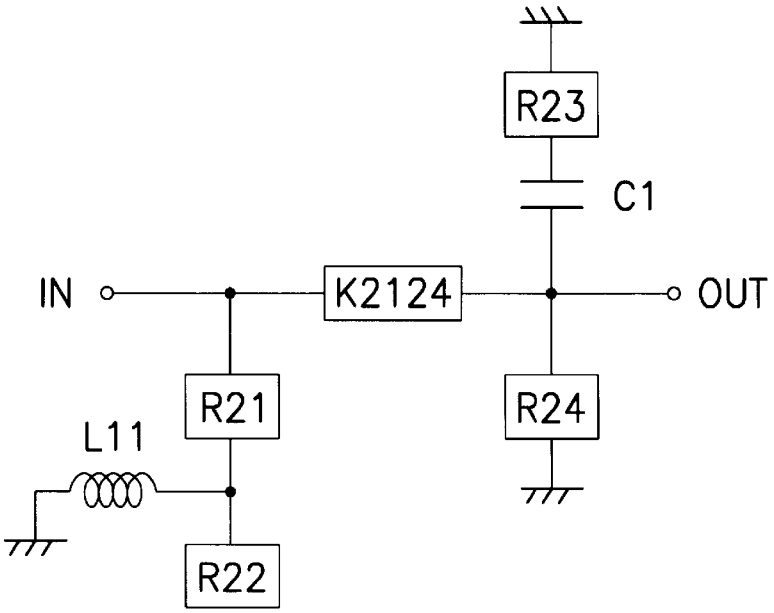
FIG. 23 is a circuit diagram of an equivalent circuit of the dielectric filter shown in FIG. 20.

As shown in FIG. 23, two filter stages are formed in the dielectric filter having the above structure (a first stage is formed with the resonators R21 and R22 and the inductor L11, and a second stage is formed with the resonators R23 and R24 and the capacitor C1). The first filter stage is connected to the input terminal IN and the second filter stage is connected to the output terminal OUT. These two filter stages are connected to each other via the phase shifter K2124. In this dielectric filter having the above structure, a signal input at the input terminal IN is shifted in phase by about 90° via the phase shifter K2124 and the phase-shifted signal appears at the output terminal OUT.

Figure 24:
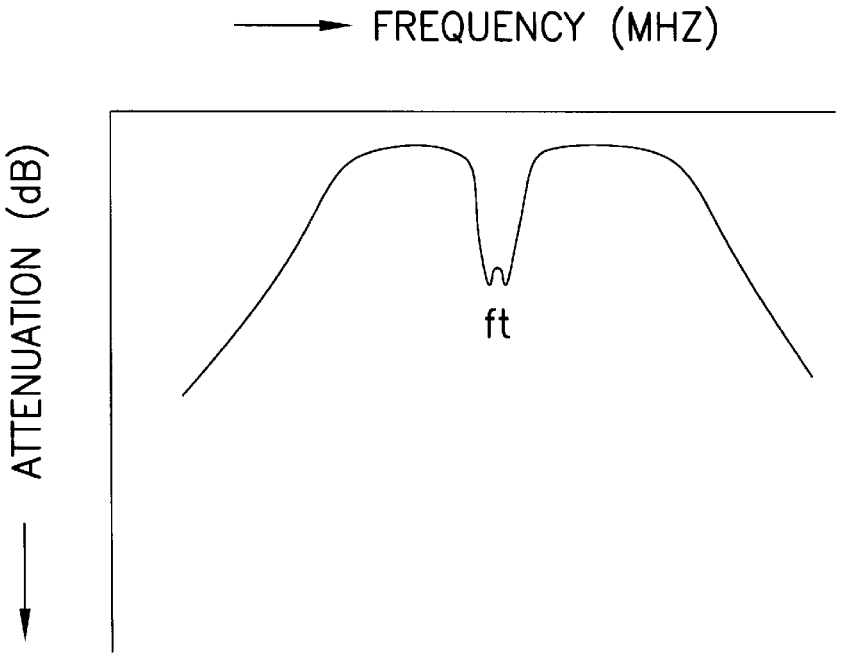
FIG. 24 is a graph illustrating the frequency characteristic of the dielectric filter shown in FIG. 20.

The dielectric filter with the above structure has two pass-bands separated by a trap frequency ft, as shown in FIG. 24, wherein elimination occurs at edges of the pass-bands. The trap frequency ft and the frequency-attenuation characteristics of the two pass-bands located at either side of the trap frequency ft are determined by properly selecting the relative dielectric constant of the dielectric block 81, the lengths of the inner conductors 85 and 86, and the inductance associated with the connection conductor 90. Since the dielectric filter of the present embodiment has two filter stages, it is possible to adjust the frequency bandwidth of the trap band, and a greater attenuation can be achieved within the trap band. Thus, this dielectric filter acts as a high-performance band-elimination filter having two pass-bands at either side of the trap frequency ft. In other words, the dielectric filter behaves both as a band-pass filter and a band-elimination is filter.

Figure 11A:
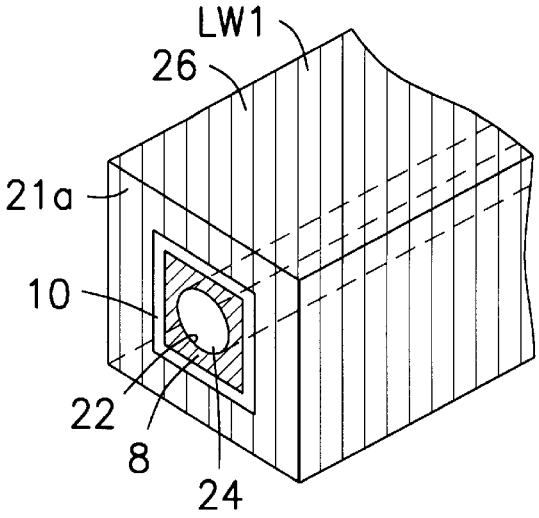
FIG. 11*a*–11*c* are views showing a sub-block of FIG. 20 having a modified end face.
Figure 11B:
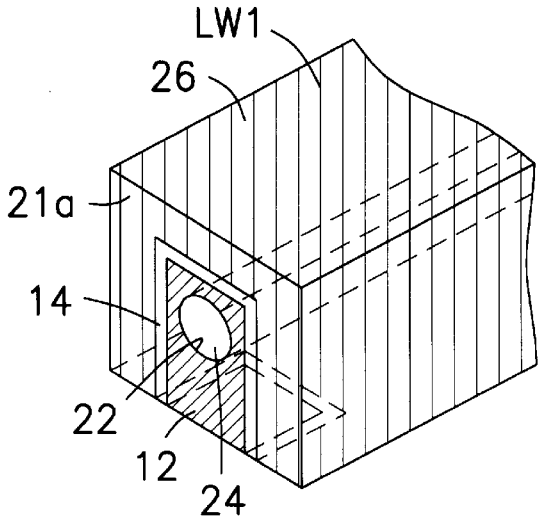

As shown in FIGS. 11*a* and 11*b*, an end face electrode similar to those shown in FIGS. 5 or 6 may be formed on the first end face 81*a* of the first sub-block LW10 such that the end face electrode on the first end face 81*a* is connected to the inner conductor 85 to serve as an input terminal IN. In this case, as in the example shown in FIGS. 5 or 6, the outer conductor 87 may have an additional portion which extends on the first end face 81*a* and which is electrically isolated from the end face electrode. The second end face 81*b* may be covered with a conductor extending from the outer conductor 87 as in the example shown in FIG. 7 (see FIG. 11*c*). The addition of the end face electrode readily permits a signal line to be connected to the inner conductor. That is, the connection can be accomplished simply by connecting the signal line to the end face electrode. Furthermore, in the case where the outer conductor 87 is formed by means of plating, the above structure having the end face electrode allows the conductors to be more easily formed, because the structure leads to a reduction in the area of the electrode material which should be removed after the plating process.

Figure 11C:
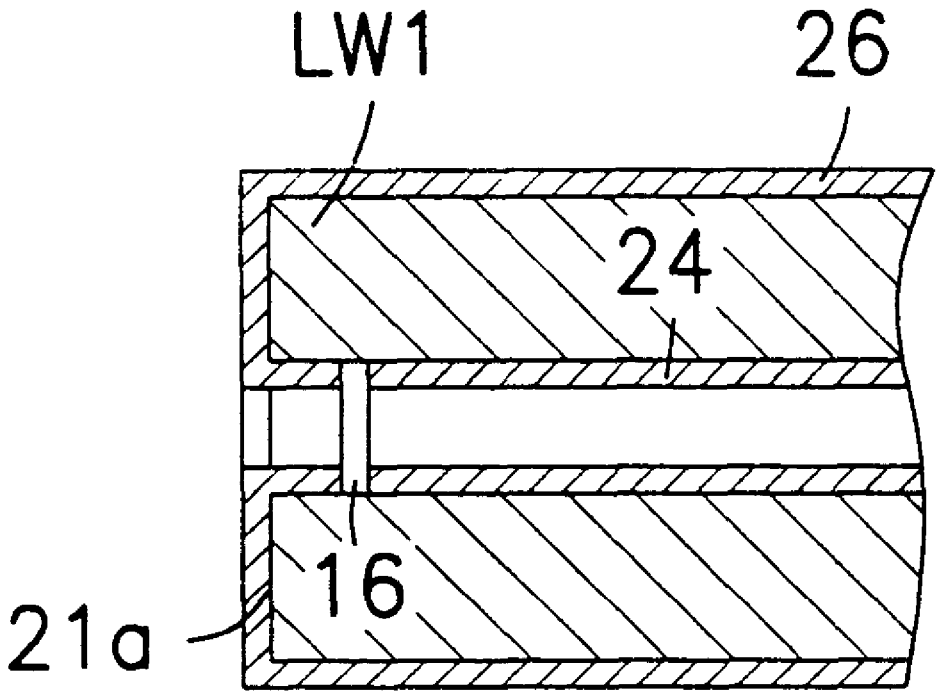

In an alternative mode, as in the example shown in FIG. 7, the inner conductor 85 may also be formed in such a manner as to have a length which does not reach either the first end face 81*a* or the second end face 81*b* (see FIG. 11*c*). In this case, the outer conductor 87 may be formed in such a manner as to have additional portions which extend over the first end face 81*a* and the second end face 81*b* and which further extend inward the through-hole 83. This structure leads to an improvement in the shielding performance of the dielectric filter.

Figure 25:
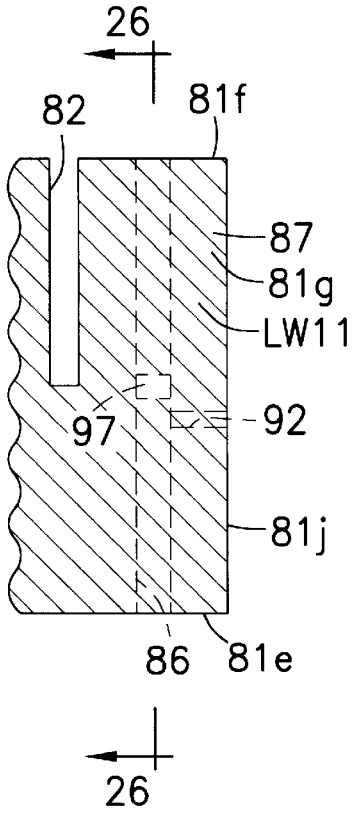
FIG. 25 is a fragmentary plan view illustrating a modification of the dielectric filter shown in FIG. 20.
Figure 26:
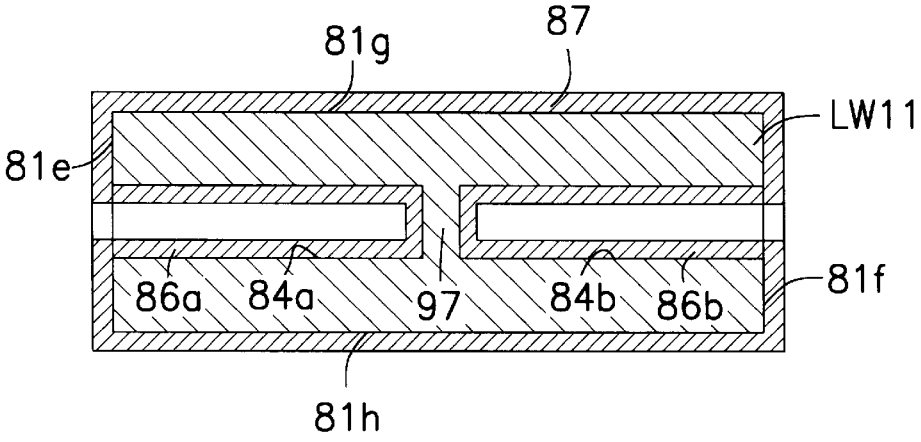
FIG. 26 is a cross-sectional view of the dielectric filter of FIG. 25 taken along line 26—26.

In another mode, as shown in a fragmentary plan view of FIG. 25 and also in a cross-sectional view of FIG. 26, taken along line 26—26 of FIG. 25, the through-hole 84 of the second sub-block LW11 may be divided into two closed-end holes 84*a* and 84*b* separated by an isolation wall 97 wherein the entire inner surfaces of both the closed-end holes 84*a* and 84*b* are covered with inner conductors 86*a* and 86*b*, respectively, and the closed ends at the isolation wall 97 act as open-circuited inner ends, like the open-circuited inner ends shown in FIGS. 21 and 22. In this case, a capacitor is formed with the two inner-end portions of the inner conductors 86*a* and 86*b* isolated by the isolation wall 97. This structure allows the open-circuited ends to be more easily formed than the structure shown in FIGS. 20–22. The slit 82 may be filled with an electrically conductive material such as metal plating.

In the above structure, the side-wall through-hole 89 is formed, as described above, in such a manner as to extend from the central part between the outer ends of the inner wall of the through-hole 83 to the upper face 81*c* of the first sub-block LW10, which is a part of the outer surface of the dielectric block 81, and the connection conductor 90 is formed on the inner surface of the side-wall through-hole 89 in such a manner that the central part between the outer ends of the inner conductor 85 is connected to the outer conductor 87 via the connection conductor 90. Herein the central part between the two ends does not necessarily need to be located at the exact geometric center but can be located within a range around the center as long as the filter has a good frequency characteristic, such as that in FIG. 24. Furthermore, in the present embodiment, although the inner conductor 86 of the second sub-block LW11 has the gap 88 located at the center between the outer ends, the location of the gap 88 may be within a certain tolerance so long as the filter has a good frequency characteristic. Similarly, the slit 82 may be formed at the center within a positional tolerance. Furthermore, the widths W10 and W11 of the respective sub-blocks may be equal to each other within a certain tolerance. Furthermore, the first end faces 81*a* and 81*e* of the respective sub-blocks LW10 and LW11 may be flush with each other within a certain positional tolerance, and the second end faces 81*b* and 81*f* may be flush with each other within a certain positional tolerance.

Figure 27:
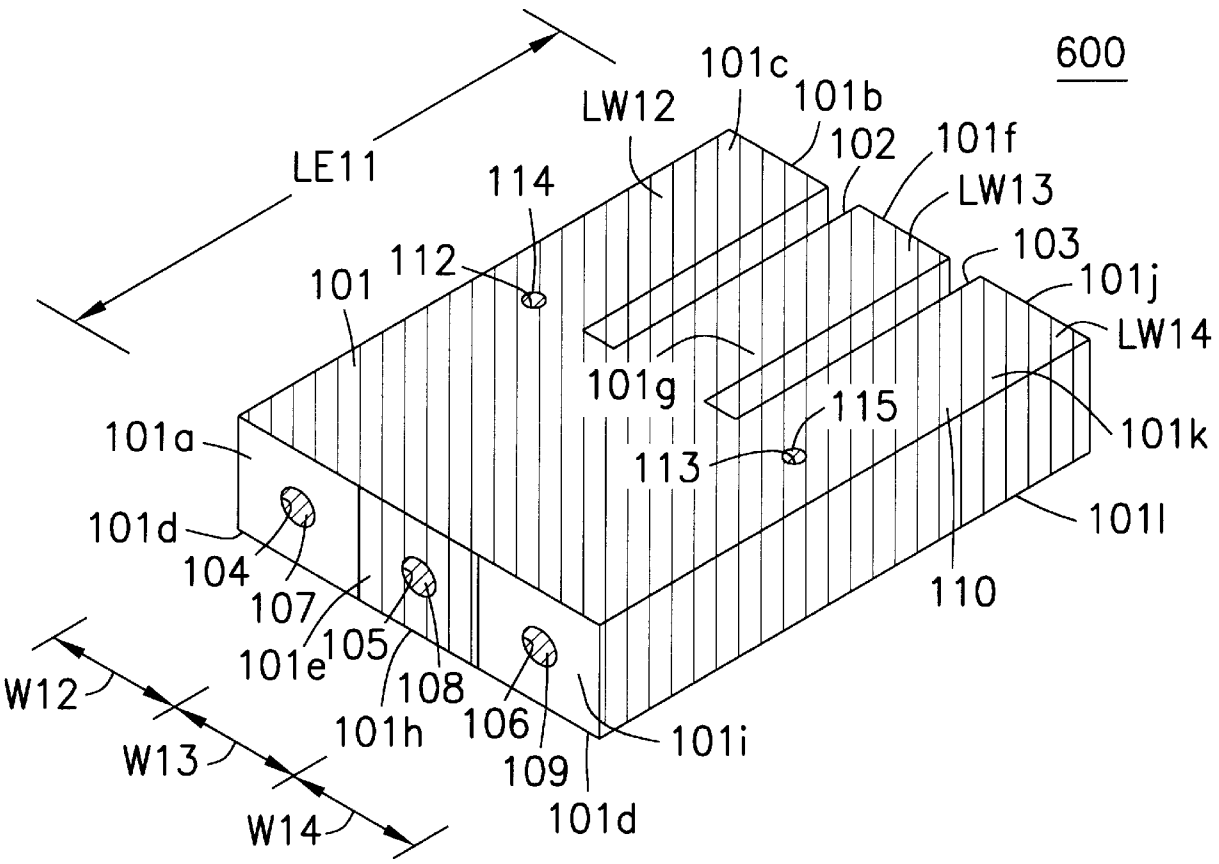
FIG. 27 is a perspective view of a sixth embodiment of a dielectric filter according to the present invention.
Figure 28:
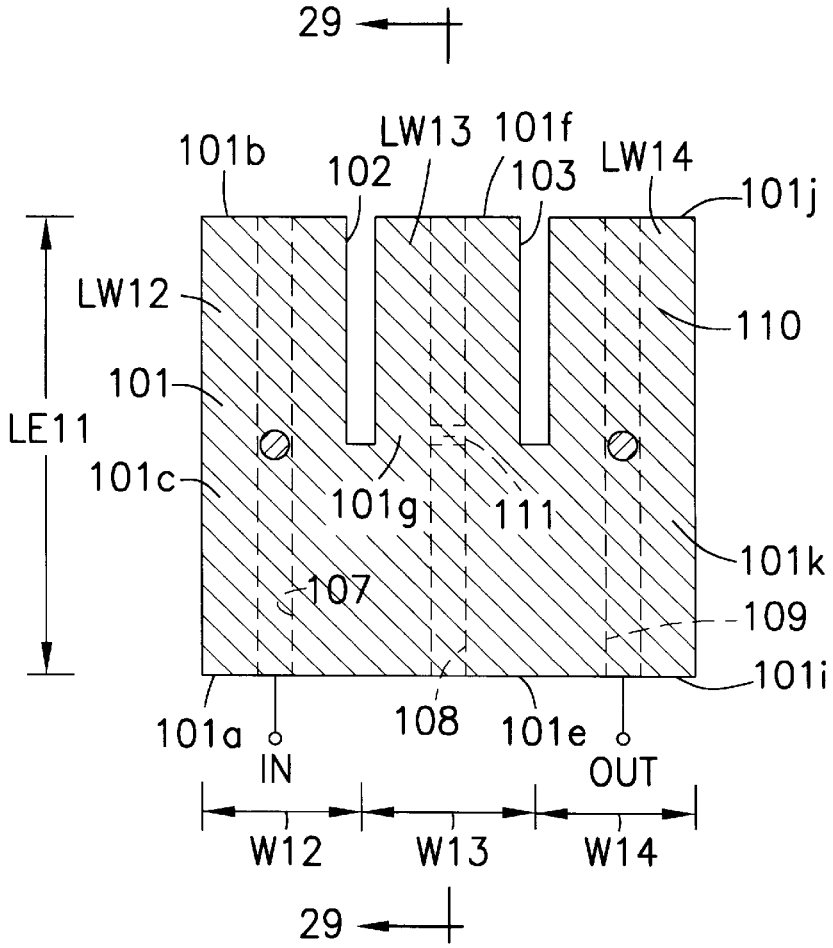
FIG. 28 is a plan view of the dielectric filter shown in FIG. 27.
Figure 29:
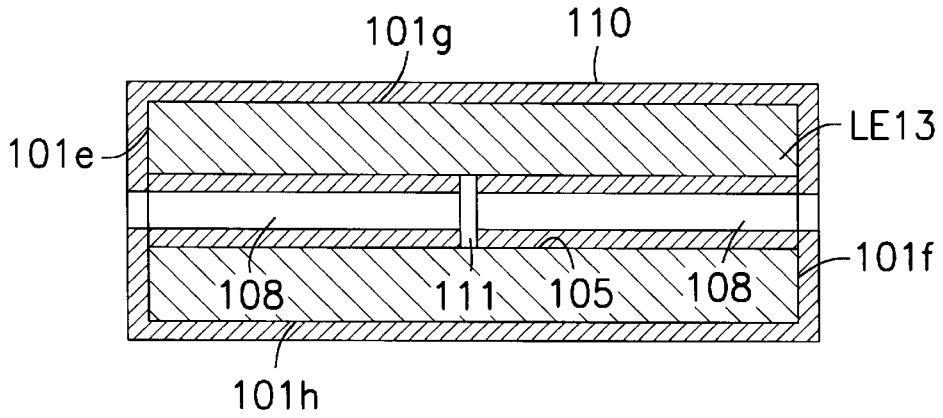
FIG. 29 is a cross-sectional view of the dielectric filter of FIG. 28 taken along line 29—29.

FIG. 27 is a perspective view of a sixth embodiment of a dielectric filter 600 according to the present invention. A plan view of FIG. 27 is shown in FIG. 28. FIG. 29 is a cross-sectional view taken along line 29—29 of FIG. 28. As shown in these figures, the dielectric filter is composed of a rectangular dielectric block 101 of a ceramic material, including a first first-type sub-block LW12, a second-type sub-block LW13, and a second first-type sub-block LW14, wherein these sub-blocks all have equal lengths LE11, equal widths W12, W13, and W14, respectively, and are formed in an integral fashion. Slits 102 and 103 with a length equal to half the length LE11 are formed between the sub-blocks LW12 and LW13 and between the sub-blocks LW13 and LW14 in such a manner that the slits 102 and 103 extend from one end face toward the central part of the dielectric block 101. These slits 102 and 103 serve as coupling preventing means for preventing electromagnetic coupling between the sub-blocks LW12 and LW13 and between the sub-blocks LW13 and LW14.

The first first-type sub-block LW12 has two opposing end faces, namely a first end face 101*a* and a second end face 101*b*, located at either end of the length LE11, and also has two opposing sides, namely an upper face 101*c* and a lower face 101*d*, which are perpendicular to the end faces 101*a* and 101*b*. The second-type sub-block LW13 has two opposing end faces, namely a first end face 101*e* and a second end face 101*f*, located at either end of the length LE11, and also has two opposing sides, namely an upper face 101*g* and a lower face 101*h*, which are perpendicular to the end faces 101*e* and 101*f*. The second first-type sub-block LW1 has two opposing end faces, namely a first end face 101*i* and a second end face 101*j*, located at either end of the length LE11, and also has two opposing sides, namely an upper face 101*k* and a lower face 101*l*, which are perpendicular to the end faces 101*i* and 101*j*. The first first-type sub-block LW12 is located on one side of the dielectric block 101, the second first-type sub-block LW14 is located on the opposite side of the dielectric block 101, and the second-type sub-block LW13 is located between these first-type sub-blocks LW12 and LW14. The first end faces 101*a*, 101*e*, and 101*i* of the respective sub-blocks LW12, LW13, and LW14 are located on a same side and lie in one plane, while the second end faces 101*b*, 101*f*, and 101*j* are located on an opposite same side and lie in another plane. The slits 102 and 103 are formed between the sub-blocks LW12 and LW13 and between the sub-blocks LW13 and LW14, respectively, such that they extend from the second end faces 101*b*, 101*f*, and 101*j* to the central parts between the first and second end faces. The upper faces 101*c*, 101*g*, and 101*k* of the respective sub-blocks LW12, LW13, and LW14 lie in one plane, and the lower faces 101*d*, 101*h*, and loll lie in another plane.

The dielectric block 101 has through-holes 104, 105, and 106 wherein the through-hole 104 is formed between the first end face 101*a* and the second end face 101*b* of the first first-type sub-block LW12, the through-hole 105 is formed between the first end face 101*e* and the second end face 101*f* of the second-type sub-block LW13, and the through-hole 104 is formed between the first end face 101*i* and the second end face 101*j* of the second first-type sub-block LW14. The inner walls of these through-holes 104, 105, and 106 are covered with inner conductors 107, 108, and 109, respectively. An outer conductor 101 is formed over the whole outer surface of the dielectric block 101 except for: (i) the first end face 101*a* and the second end face 101*b* of the first first-type sub-block LW12; and (ii) the first end face 101*i* and the second end face 101*j* of the second first-type sub-block LW14.

Neither end of the inner conductor 107 of the first first-type sub-block LW12 is connected to the outer conductor 110 and thus the inner conductor 107 is electrically open-circuited at both ends. Similarly, neither end of the inner conductor 109 of the second first-type sub-block LW14 is connected to the outer conductor 110 and thus the inner conductor 109 is electrically open-circuited at both ends. On the other hand, both ends of the inner conductor 108 of the second-type sub-block LW13 are connected to the outer conductor 110 and thus the inner conductor 108 is electrically short-circuited at both ends. The inner conductor 108 of the second-type sub-block LW13 has a gap at a central part between the two outer ends 101*e*, 101*f*, wherein open-circuited inner ends 111 are formed at the gap. A capacitor is formed by these two inner ends 111 facing each other across the gap.

The inner conductors 107, 108, 109 and the outer conductor 110 may be formed, for example, from an electrode material such as Cu covering the whole surface of the dielectric block 101 including the inner walls of the slits 102 and 103 and the through-holes 104, 105, and 106 by means of electroless plating or the like, which is then removed from the first end face 101*a* and the second end face 101*b* of the first first-type sub-block LW12 and also from the first end face 101*i* and the second end face 101*j* of the second first-type sub-block LW14.

The dielectric block 101 has side-wall through-holes 112 and 113. The side-wall through-hole 112 extends from the central part between the two opposing ends of the inner wall of the through-hole 104 of the first first-type sub-block LW12 to the upper face 101*c* of the first first-type sub-block LW12, wherein the upper face 101*c* is a part of the outer surface of the dielectric block 101. The side-wall through-hole 113 extends from the central part between the two opposing ends of the inner wall of the through-hole 106 of the second first-type sub-block LW14 to the upper face 101*k* of the second first-type sub-block LW14, wherein the upper face 101*k* is a part of the outer surface of the dielectric block 101. The inner walls of the side-wall through-holes 112 and 113 are covered with connection conductors 114 and 115, respectively, so that the central parts between the two opposing ends of the respective inner conductors 107 and 109 are connected to the outer conductor 110 via these connection conductors 114 and 115. These connection conductors 114 and 115 may be is formed, for example, at the same time as the inner conductors 107, 108, 109 and the outer conductor 110, by subjecting the inner walls of the side-wall through-holes 112 and 113 to the plating process when forming the inner conductors 107, 108, 109 and the outer conductor 110.

In the dielectric filter having the structure described above, the end of the inner conductor 107 on the side of the first end face 101*a* of the first first-type sub-block LW12 is used as an input terminal IN, while the end of the inner conductor 109 on the side of the first end face 101*i* of the second first-type sub-block LW14 is used as an output terminal OUT. The outer conductor 110 is connected to a ground line. Thus, the dielectric filter of the present embodiment can be represented by an equivalent circuit shown in FIG. 30.

In this equivalent circuit, R25 and R26 are two resonators formed with the inner conductor 107 of the first first-type sub-block LW12, the inner conductor 107 being divided into two sections at the center between the two ends. R27 and R28 are two resonators formed from the inner conductor 108 of the second-type sub-block LW13, the inner conductor 108 being divided into two sections at the center between the two ends. R29 and R30 are two resonators formed from the inner conductor 109 of the second first-type sub-block LW14, the inner conductor 109 being divided into two sections at the center between the two ends. L12 is an inductor associated with the connection conductor 114 of the first first-type sub-block LW12, and L13 is an inductor associated with the connection conductor 115 of the second first-type sub-block LW14. C2 is a capacitor formed between the open-circuited inner ends 111 of the inner conductor 108 of the second-type sub-block LW13.

K2528 is a phase shifter formed between a part of the first first-type sub-block LW12 of the dielectric block 101 extending from the first end face 101*a* to the connection conductor 114, and a part of the second-type sub-block LW13 extending from the first end face 101*e* to the open-circuited inner end 111 of the inner conductor 108. K2829 is a phase shifter formed between a part of the second-type sub-block LW13 of the dielectric block 101 extending from the first end face 101*e* to the open-circuited inner end 111 of the inner conductor 108, and a part of the second first-type sub-block LW14 extending from the first end face 101*i* to the connection conductor 109.

As described above, the dielectric filter of the present embodiment includes: the dielectric block 101 composed of the first first-type sub-block LW12 having the two opposing end faces namely the first end face 101*a* and the second end face 101*b*, the second-type sub-block LW13 having the two opposing end faces namely the first end face 101*e* and the second end face 101*f*, the second first-type sub-block LW14 having the two opposing end faces namely the first end face 101*i* and the second end face 101*j*; the through-hole 104 formed between the first end face 101*a* and the second end face 101*b* of the first first-type sub-block LW12 of the dielectric block 101; the inner conductor 107 formed on the inner wall of the through-hole 104 wherein both ends of the inner conductor 107 are electrically open-circuited; the through-hole 106 formed between the first end face 101*i* and the second end face 101*j* of the second first-type sub-block LW14 of the dielectric block 101; the inner conductor 109 formed on the inner wall of the through-hole 106 wherein both ends of the inner conductor 109 are electrically open-circuited; the outer conductor 110 formed on the outer surface of the dielectric block 101; the connection conductor 114 by which the central part between the two opposing ends of the inner conductor 107 of the first first-type sub-block LW12 is connected to the outer conductor 110; the connection conductor 115 by which the central part between the two opposing ends of the inner conductor 109 of the second first-type sub-block LW14 is connected to the outer conductor 110; the through-hole 105 formed between the first end face 101*e* and the second end face 101*f* of the second-type sub-block LW13 of the dielectric block 101; and the inner conductor 108 formed on the inner wall of the through-hole 105, wherein electrically open-circuited inner ends 111 are formed at the center of the inner conductor 108 while both outer ends of the inner conductor 108 are electrically short-circuited.

Figure 30:
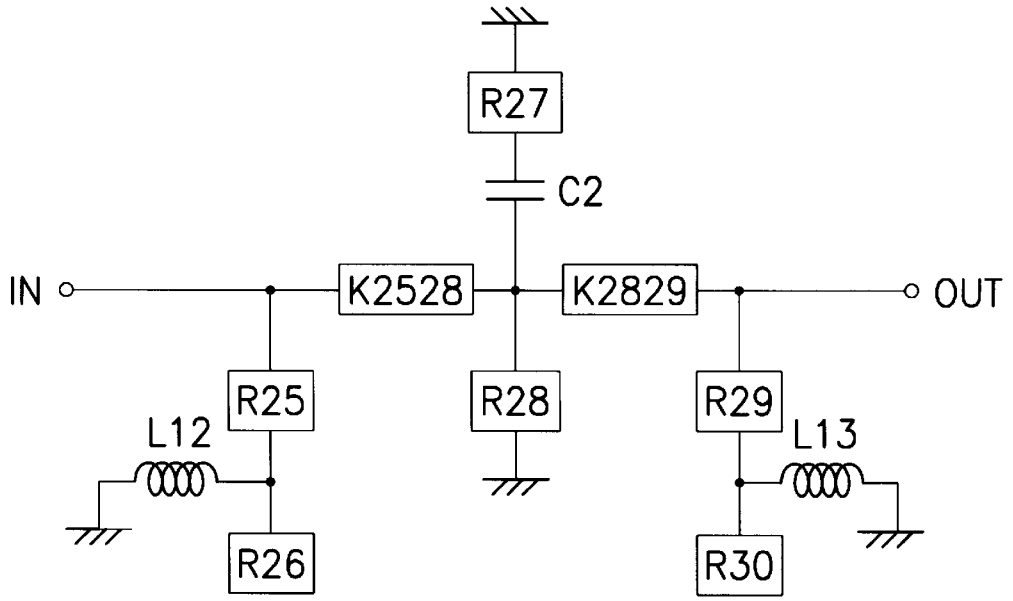
FIG. 30 is a circuit diagram of an equivalent circuit of the dielectric filter shown in FIG. 27.

As shown in FIG. 30, three filter stages are formed in the dielectric filter having the above structure (a first stage is formed with the resonators R25 and R26 and the inductor L12, a second stage is formed with the resonators R27 and R28 and the capacitor C2, and a third stage is formed with the resonators R29 and R30 and the inductor L13). These three filter stages are coupled from one stage to the next via the respective phase shifters K2528 and K2829. The filter stage including the resonator R25 is connected to the input terminal IN and the filter stage including the resonator R29 is connected to the output terminal OUT. In this dielectric filter having the above structure, a signal given at the input terminal IN is shifted in phase by about 90° via each phase shifter K2528, K2829 and the phase-shifted signal appears at the output terminal OUT.

Figure 31:
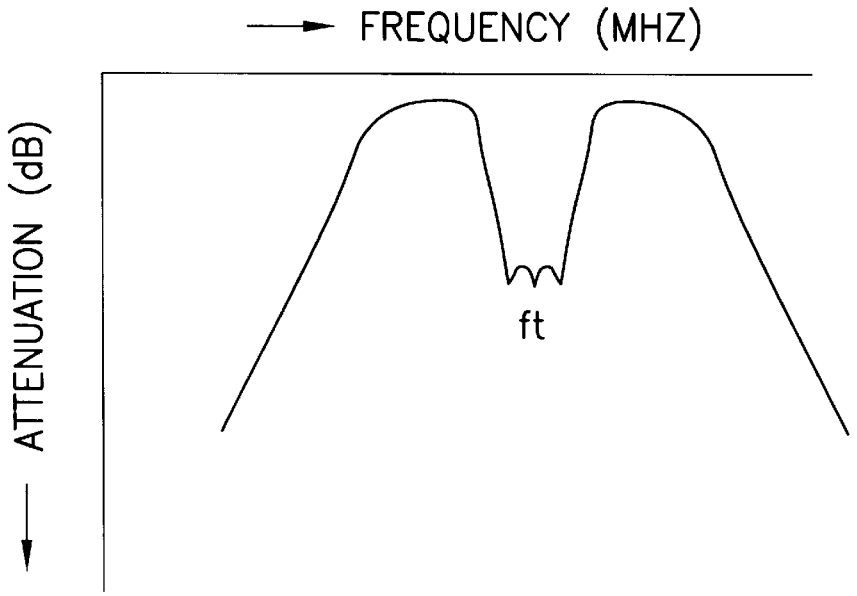
FIG. 31 is a graph illustrating the frequency characteristic of the dielectric filter shown in FIG. 27.

The dielectric filter with the above structure has two pass-bands separated by a trap frequency ft, as shown in FIG. 31, wherein elimination occurs at edges of the pass-bands. The trap frequency ft and the frequency characteristics of the two pass-bands located at either side of the trap frequency ft are determined by properly selecting the relative dielectric constant of the dielectric block 101, the lengths of the inner conductors 107, 108, and 109, and the inductances associated with the connection conductors 114 and 115. Since the dielectric filter of the present embodiment has three filter stages, it is possible to adjust the frequency bandwidth of the trap band and a greater attenuation can be achieved within the trap band. Thus, this dielectric filter acts as a high-performance band-elimination filter having two pass-bands at either side of the trap frequency ft. In other words, the dielectric filter behaves both as a band-pass filter and a band-elimination filter.

As shown in FIGS. 11*a* and 11*b*, end face electrodes similar to those shown in FIGS. 5 or 6 may be formed on the first end face 101*a* of the first first-type sub-block LW12 and on the first end face 101*i* of the second first-type sub-block LW14 such that the end face electrode on the first end face 101*a* is connected to the inner conductor 107 to serve as an input terminal IN and the end face electrode on the first end face 101*i* is connected to the inner conductor 109 to serve as an output terminal OUT. In this case, as in the example shown in FIGS. 5 or 6, the outer conductor 110 may have additional portions which extend on the first end face 81*a* and which are electrically isolated from the end face electrode. The second end faces 101*b* and 101*j* may be covered with conductors extending from the outer conductor 110 as in the example shown in FIG. 7 (see FIG. 16). The addition of the end face electrodes readily permits a signal line to be connected to the inner conductors. That is, the connection can be accomplished simply by connecting the signal line to the end face electrodes. Furthermore, in the case where the outer conductor 110 is formed by means of plating, the above structure having the end face electrodes allows the conductors to be more easily formed, because the structure leads to a reduction in the area of the electrode material which should be removed after the plating process.

In an alternative mode, as in the example shown in FIG. 7, the inner conductor 107 of the first first-type sub-block LW12 and the inner conductor 109 of the second first-type sub-block LW14 may also be formed in such a manner as to have a length which does not reach either the first end faces 101*a*, 101*i* or the second end faces 101*b*, 101*j* (see FIG. 11*c*). In this case, the outer conductor 110 may have additional portions which extend over the first end faces 101*a*, 101*i* and the second end faces 101*b*, 101*j* and which further extend inward the through-holes 104, 106. This structure leads to an improvement in the shielding performance of the dielectric filter.

Figure 32:
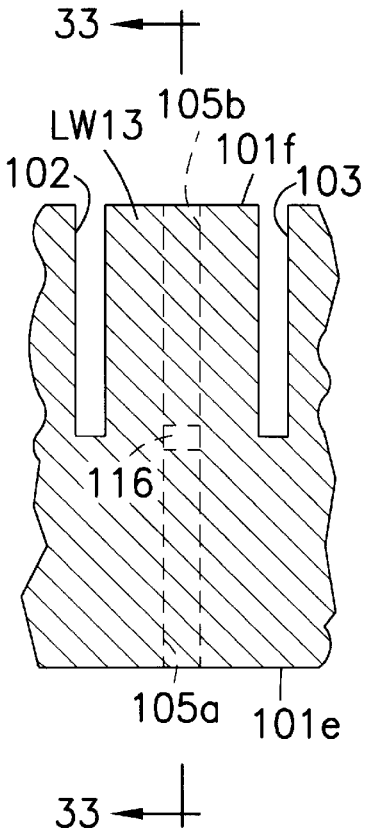
FIG. 32 is a fragmentary plan view illustrating a modification of the dielectric filter shown in FIG. 27.
Figure 33:
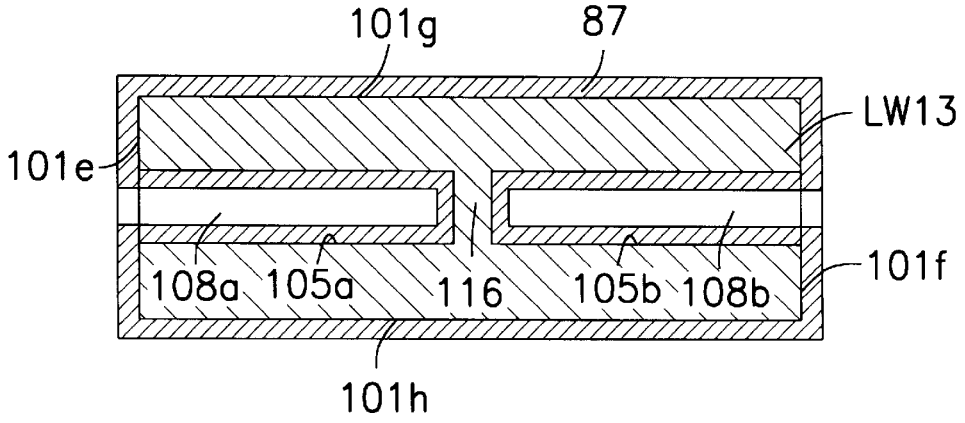
FIG. 33 is a cross-sectional view of the dielectric filter of FIG. 32 taken along line 33—33.

In another mode, as shown in a fragmentary plan view of FIG. 32 and also in a cross-sectional view of FIG. 33, taken along line 33—33 of FIG. 32, the through-hole 105 of the second-type sub-block LW13 may be divided into two closed-end holes 105*a* and 105*b* separated by an isolation wall 116 wherein the entire inner surfaces of both the closed-end holes 105*a* and 105*b* are covered with inner conductors 106*a* and 106*b*, respectively, and the closed ends at the isolation wall 116 act as open-circuited inner ends 111 as the open-circuited inner ends shown in FIGS. 28 and 29. In this case, a capacitor is formed with the two inner-end portions of the inner conductors 106*a* and 106*b* isolated by the isolation wall 116. This structure allows the open-circuited ends to be more easily formed than the structure shown in FIGS. 27–29. The slits 102 and 103 may be filled with an electrically conductive material such as a metal plate.

In the above structure, the side-wall through-hole 112 of the first first-type sub-block LW12 and the side-wall through-hole 113 of the second first-type sub-block LW14 are formed, as described above, in such a manner that they extend from the central part between the outer ends of the inner wall of the through-hole 104 or 109 to the upper face 101*c* of the first first-type sub-block LW12 or to the upper face 101*k* of the second first-type sub-block LW14 wherein the upper faces 101*c* and 101*k* are parts of the outer surface of the dielectric block 101. The connection conductors 114 and 115 are formed on the inner surfaces of the side-wall through-holes 112 and 113 so that the central parts between the outer ends of the inner conductors 107 and 109 are connected to the outer conductor 110 via the connection conductors 114 and 115. Herein the "central part" between the two ends does not necessarily need to be located at the exact geometric center but can be located within a range around the center as long as the filter has a good frequency characteristic, such as shown herein. Furthermore, in the present embodiment, although the inner conductor 108 of the second-type sub-block LW13 has the open-circuited inner ends 111 located at the center between the outer ends, the location of the open-circuited inner ends 88 may have a certain tolerance so long as the filter has a good frequency characteristic. Similarly, the slits 102 and 103 may be formed at the centers within a positional tolerance. Furthermore, the widths W12, LW13, and W14 of the respective sub-blocks may be equal to one another within a certain tolerance. Furthermore, the equality of the first end faces 101*a*, 101*e*, 101*j* of the respective sub-blocks LW12, LW13, and LW14 may have a certain positional tolerance, and the second end faces 101*b*, 101*f*, 101*j* may be flush with one another within a certain positional tolerance.

Figure 34:
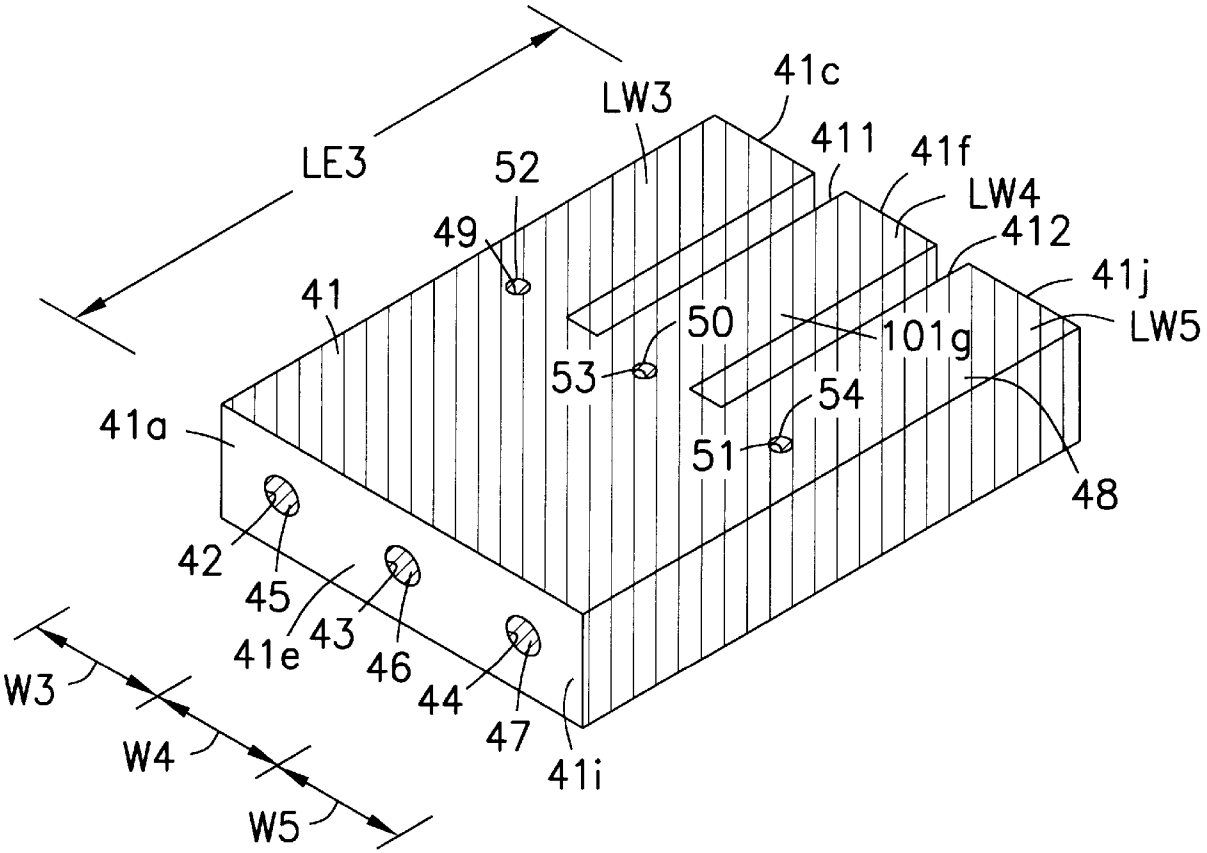
FIG. 34 is a perspective view of a dielectric filter having a similar equivalent circuit and similar characteristics to those of the dielectric filter according to the third embodiment shown in FIGS. 12 and 13.

Although, the dielectric filter of the present invention is described above with reference to preferred embodiments, the present invention is not limited to the details described, but various modifications and changes may be made. For example although in the specific embodiment described above in conjunction with FIGS. 12 and 13, the dielectric block 41 is composed of three sub-blocks LW3, LW4, and LW5 which are shifted in position in longitudinal directions by half the length LE3, LE4, or LE5, the dielectric block 41 may also be formed into a rectangular shape as shown in FIG. 34 to achieve a dielectric filter having an equivalent circuit similar to that shown in FIG. 14 and thus having a similar characteristic to that shown in FIG. 15. This structure will be described in greater detail below. In FIG. 34, similar parts or elements to those of FIGS. 12 and 13 are denoted by similar reference numerals, and they are not described herein in further detail.

In the dielectric filter shown in FIG. 34, the dielectric block 41 includes three sub-blocks LW3, LW4, and LW5 having equal widths W3, W4, W5, respectively. These sub-blocks also have first end faces 41*a*, 41*e*, and 41*i* which are located on a same side and which lie in one plane. The sub-blocks further have second end faces 41*c*, 41*f*, and 41*j* which are located on an opposite side and which lie in another plane. The dielectric block 41 also has slits 411 and 412 serving as electromagnetic coupling preventing structures formed between the sub-blocks LW3 and LW4 and between the sub-blocks LW4 and LW5, respectively, wherein these slits 41*l* and 412 extend from the second end faces 41*c*, 41*f*, and 41*j* toward the central parts between opposite end faces. An outer conductor 48 is formed on the inner walls of these slits 411 and 412.

In the dielectric filter having the structure described above, the end of the inner conductor 45 on the side of the first end face 41*a* of the sub-block LW3 is used as an input terminal IN, while the end of the inner conductor 47 on the side of the first end face 41*i* of the sub-block LWS is used as an output terminal OUT.

In the structure shown in FIG. 34, instead of employing the slits 411 and 412, the electromagnetic coupling preventing structures may also be realized by forming the respective through-holes 42, 43, and 44 with a so-called step structure (not shown). In the step structure, each through-hole 42, 43, 44 has a smaller diameter in the region from the second end faces 41*c*, 41*f*, 41*j* to the center between the two opposing ends than in the region from the center between the two opposing ends to the first end faces 41*a*, 41*e*, 41*i*.

End face electrodes similar to those shown in FIGS. 5 or 6 may be formed on the first end faces 41*a* and 41*i* such that the end face electrode on the first end face 41*a* serves as an input terminal IN and the end face electrode on the first end face 41*i* serves as an output terminal OUT (see FIGS. 11*a*–11*b*). In this case, as in the example shown in FIGS. 5 or 6, the outer conductor 48 may have additional portions which extend onto the first end faces 41*a* and 41*i* while being electrically isolated from the end face electrodes. The other end faces may be covered with conductors extending from the outer conductor 48 as in the example shown in FIG. 7 (see also, FIG. 11*c*). The slits 411 and 412 may be filled with an electrically conductive material such as metal plating.

Figure 35:
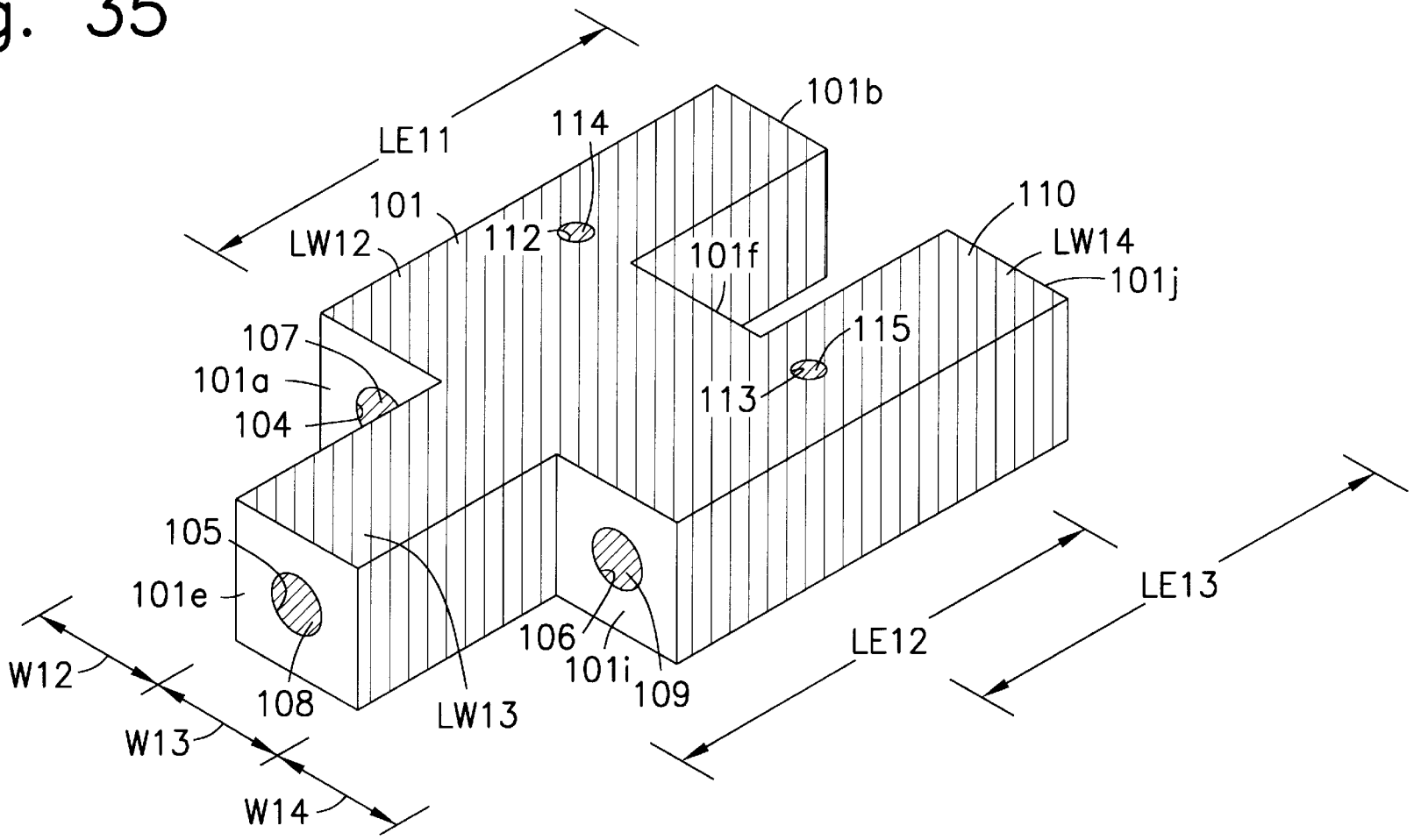
FIG. 35 is a perspective view of a dielectric filter having a similar equivalent circuit and similar characteristics to those of the dielectric filter according to the sixth embodiment shown in FIGS. 27 and 28.
Figure 36:
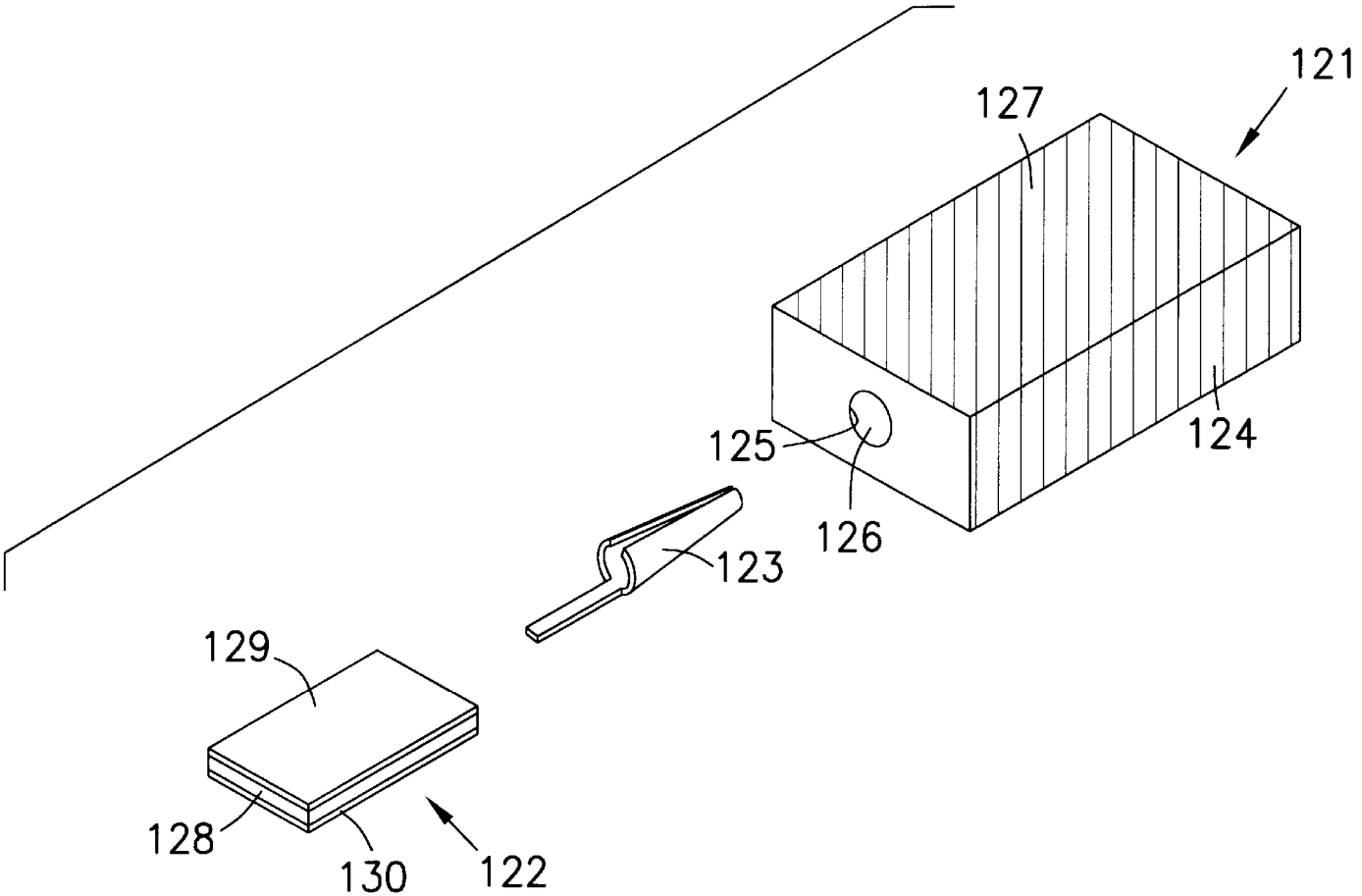
Fig. 36 Prior Art
FIG. 36 is an exploded perspective view of a conventional dielectric filter.
Figure 37:
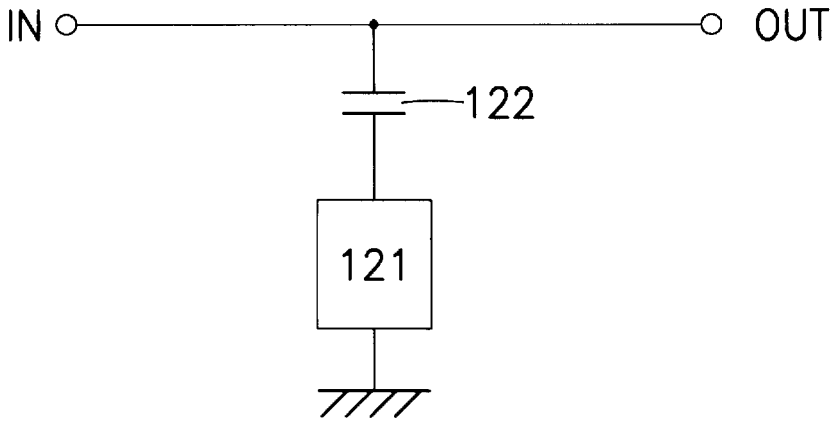
Fig. 37 Prior Art
FIG. 37 is a circuit diagram of an equivalent circuit of the dielectric filter shown in FIG. 36.
Figure 38:
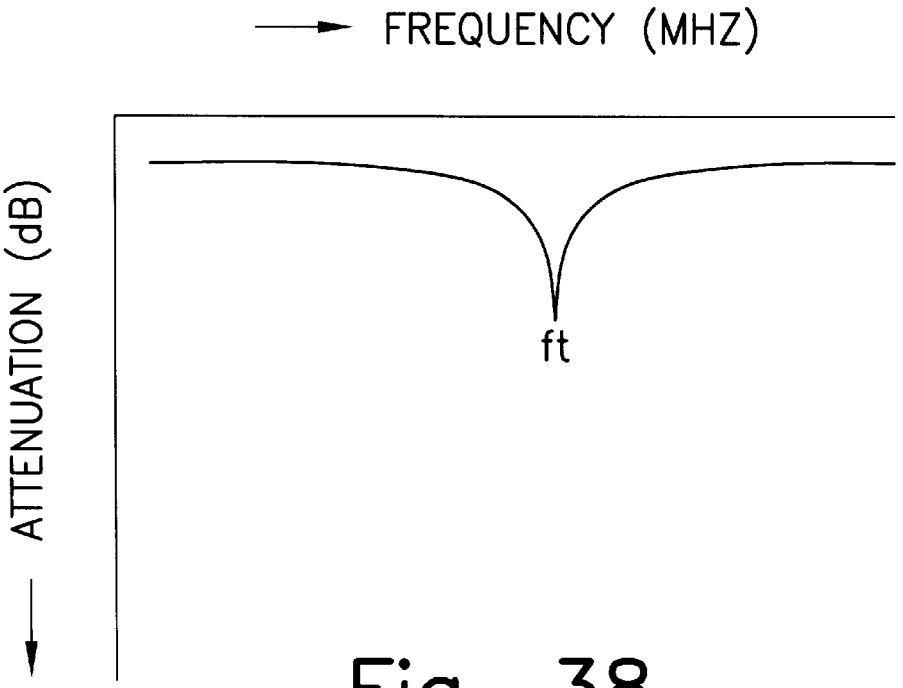
Fig. 38 Prior Art
FIG. 38 is a graph illustrating the frequency characteristic of the dielectric filter shown in FIG. 36.

Although in the specific example shown in FIGS. 27 and 28, the dielectric filter includes a rectangular-shaped dielectric block 101 composed of three sub-blocks LW12, LW13, and LW14, the dielectric block 101 may also be formed into the shape shown in FIG. 35 to achieve a dielectric filter having an equivalent circuit similar to that shown in FIG. 30 and thus having a similar characteristic to that shown in FIG. 31. This structure will be described in greater detail below. In FIG. 35, similar parts or elements to those of FIGS. 27 and 28 are denoted by similar reference numerals, and they are not described herein in further detail.

In the dielectric filter shown in FIG. 35, the dielectric block 101 includes three sub-blocks LW12, LW13, and LW14 having equal widths W12, W13, W14, respectively. These three sub-blocks LW12, LW13, and LW14 are shifted in position relative to adjacent sub-blocks in longitudinal directions by half the length LE11, LE12, or LE13 (toward end faces).

In this structure, the end of the inner conductor 107 on the side of the first end face 101*a* of the sub-block LW12 is used as an input terminal IN, while the end of the inner conductor 109 on the side of the first end face 101*i* of the sub-block LW14 is used as an output terminal OUT. End face electrodes similar to those shown in FIGS. 5 or 6 may be formed on the first end faces 101*a* and 101*i* such that the end face electrode on the first end face 101*a* serves as an input terminal IN and the end face electrode on the first end face 101*i* serves as an output terminal OUT. In this case, as in the example shown in FIGS. 5 or 6, the outer conductor 110 may have additional portions which extend onto the first end faces 101*a* and 101*i* and are electrically isolated from the end face electrodes. The second end faces 101*b* and 101*j* may be covered with conductors extending from the outer conductor 110 as in the example shown in FIG. 7.

As described above, in the dielectric filter according to first to fifth aspects of the present invention, the dielectric filter includes the connection conductor for connecting the central part of the inner conductor between its opposing ends to the outer conductor. This structure allows the dielectric filter having the single dielectric block to behave as a band-elimination filter having band-pass regions at either side of the trap frequency wherein elimination occurs at both band edges of the pass-bands. Since such filter characteristics can be realized using only the single dielectric block, it is becomes easier to mount the dielectric filter on a circuit board.

In the dielectric filter according to the second aspect, the connection conductor is disposed in the side-wall through-hole such that the central part of the inner conductor is connected to the outer conductor via the connection conductor thereby ensuring that the inductor has a stable inductance.

In the dielectric filter according to the third aspect, the dielectric filter includes a plurality of filter stages. This makes it possible to adjust the frequency bandwidth of the trap band, and a great attenuation can be achieved within the trap band. The dielectric filter has pass-bands centered around the trap band, wherein excellent elimination characteristics are achieved at the edges of the pass-bands. Furthermore, the dielectric block is constructed with a plurality of sub-blocks each having a through-hole in such a manner that the sub-blocks are shifted in position relative to each other in longitudinal directions so that undesirable coupling among the different filter stages is prevented thereby ensuring that the dielectric filter exhibits stable and excellent filtering characteristics.

In the dielectric filter according to the fourth aspect, the dielectric filter includes a plurality of filter stages. This makes it possible to adjust the frequency bandwidth of the trap band, and a great attenuation can be achieved within the trap band. The dielectric filter has pass-bands centered around the trap band, wherein excellent elimination characteristics are achieved at the edges of the pass-bands. Furthermore, the dielectric block is constructed with a plurality of sub-blocks each having a through-hole wherein an electromagnetic coupling preventing structure is provided between adjacent sub-blocks so that undesirable coupling among the different filter stages is prevented thereby ensuring that the dielectric filter exhibits stable and excellent filtering characteristics.

In the dielectric filter according to the fifth is aspect, the connection conductor is disposed in the side-wall through-hole such that the central part of the inner conductor is connected to the outer conductor via the connection conductor thereby ensuring that the inductor has a stable inductance and thus the dielectric filter exhibits stable and excellent filtering characteristics.

In the dielectric filter according to sixth to eighth aspects of the present invention, the dielectric filter includes the first sub-block in which the central part of the inner conductor of the first sub-block is connected to the outer conductor via the connection conductor and also includes the second sub-block including the inner conductor having open-circuited inner ends located at the center of the inner conductor. This structure allows the dielectric filter having a single dielectric block to behave as a band-elimination filter having pass-bands centered around the trap frequency wherein excellent elimination characteristics are achieved at the edges of the pass-bands. Since such filter characteristics can be realized using only the single dielectric block, it becomes easier to mount the dielectric filter on a circuit board. Furthermore, since the dielectric filter includes a plurality of filter stages it is possible to adjust the frequency bandwidth of the trap band, and a great attenuation can be achieved within the trap band. This also ensures that the dielectric filter with the pass-bands centered around the trap frequency has excellent elimination characteristics at the edges of the pass-bands.

In the dielectric filter according to the sixth aspect, the dielectric block is constructed with a plurality of sub-blocks each having a through-hole wherein an electromagnetic coupling preventing structure is provided between adjacent sub-blocks so that undesirable coupling among the different filter stages is prevented thereby ensuring that the dielectric filter exhibits stable and excellent filtering characteristics.

In the dielectric filter according to the seventh aspect, the dielectric block is constructed with a plurality of sub-blocks each having a through-hole in such a manner that the sub-blocks are shifted in position relative to each other in longitudinal directions so that undesirable coupling among the different filter stages is prevented thereby ensuring that the dielectric filter exhibits stable and excellent filtering characteristics.

In the dielectric filter according to the eighth aspect, the connection conductor is disposed in the side-wall through-hole such that the central part of the inner conductor is connected to the outer conductor via the connection conductor thereby ensuring that the inductor has a stable inductance and thus the dielectric filter exhibits stable and excellent filtering characteristics.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter, comprising:

a dielectric block including a plurality of elongated sub-blocks each having a pair of longitudinally opposing end faces and an outer surface, said sub-blocks being disposed adjacent one another;

a plurality of longitudinally extending through-holes, at least one through-hole being formed between each corresponding pair of opposing end faces of the respective sub-blocks;

a plurality of inner conductors, one inner conductor being formed on each of the inner surfaces of said plurality of through-holes, said plurality of inner conductors each having two opposing ends;

an outer conductor formed on the outer surface of said is dielectric block such that (i) the outer conductor is not electrically coupled to the respective ends of the inner conductor of every other sub-block such that the ends of those inner conductors are open-circuited, and (ii) the outer conductor is electrically coupled to the respective ends of the inner conductor of the remaining sub-blocks such that the ends of those inner conductors are short-circuited;

a plurality of connection conductors through which respective parts of the inner conductors located between corresponding open-circuited opposing ends are connected to said outer conductor; and a respective electromagnetic coupling preventing structure formed between each adjacent pair of sub-blocks and extending from one end face of each of said sub-blocks toward a central part of said sub-blocks between the two opposing end faces, wherein said dielectric filter produces a band elimination transfer function over some frequencies and a band pass transfer function over other frequencies in use.

2. The dielectric filter of claim 1, wherein respective distances between corresponding pairs of opposing end faces define respective lengths of the sub-blocks, the lengths of the sub-blocks being substantially equal.

3. The dielectric filter of claim 9, wherein the adjacent sub-blocks are not substantially longitudinally shifted from one another.

4. The dielectric filter of claim 1, wherein each of the sub-blocks having inner conductors with open-circuited ends further comprises a laterally disposed hole extending from a substantially central part of its longitudinally extending through-hole to its outer surface, the laterally disposed hole including a respective one of said plurality of connection conductors which electrically communicates with the inner conductor of the longitudinally extending through-hole and the outer conductor of the dielectric block.

5. The dielectric filter of claim 4, wherein each of the sub-blocks having inner conductors with short-circuited ends further comprises a gap in the respective inner conductor such that the inner conductor is open-circuited between its ends.

6. The dielectric filter of claim 5, wherein each gap separates respective first and second portions of the respective inner conductors.

7. The dielectric filter of claim 6, wherein each gap defines a capacitor coupled between the first and second portions of the respective inner conductors.

8. The dielectric filter of claim 6, wherein each gap is defined by an absence of conductive material in the respective inner conductors.

9. The dielectric filter of claim 6, wherein each gap is defined by an isolation wall formed from the dielectric material of the respective sub-block.

10. The dielectric filter of claim 9, wherein each isolation wall interrupts the respective longitudinally extending through hole and defines respective closed ends of the first and second portions of the respective inner conductors.

11. The dielectric filter of claim 6, comprising:

a first of said plurality of sub-blocks having an inner conductor with open-circuited ends and a first laterally disposed hole extending from substantially central part of its longitudinally extending through-hole to its outer surface, the first laterally disposed hole including a connection conductor which electrically connects the inner conductor with the outer conductor of the dielectric block; and an adjacent second of said plurality of sub-blocks having an inner conductor with short-circuited ends, the adjacent sub-block having a second laterally disposed hole extending from a substantially central part of its respective longitudinally extending through-hole to its respective outer surface, the second laterally disposed hole being substantially transverse with respect to the first laterally disposed hole and including a connection conductor which electrically communicates with the first portion of the inner conductor of its longitudinally extending through-hole but does not electrically connect to the outer conductor of the dielectric block.

12. The dielectric filter of claim 11, wherein the electromagnetic coupling preventing structure is disposed substantially adjacent to the second portion of the inner conductor of the second sub-block.

13. The dielectric filter of claim 12, wherein the electromagnetic coupling preventing structure is defined by a longitudinal slit extending from one end face of each of said adjacent sub-blocks toward the central part of said sub-blocks.

14. The dielectric filter of claim 13, wherein the longitudinal slit terminates at a position substantially adjacent to the gap.

15. The dielectric filter of claim 11, further comprising a conductive electrode disposed on and covering a portion of the outer surface of the second sub-block and connected to the connecting conductor of the second laterally disposed hole but electrically insulated from the outer conductor.

16. The dielectric filter of claim 15, wherein the conductive electrode is an output electrode.

17. The dielectric filter of claim 11, further comprising an electrically conductive electrode disposed on and covering a portion of one of the end faces of the first sub-block, the electrode being proximate to the respective through-hole at the end face and being electrically connected to the respective inner conductor of the through-hole but electrically insulated from the outer conductor.

18. The dielectric filter of claim 17, wherein the conductive electrode is an input electrode.

19. The dielectric filter of claim 11, wherein:

the open-circuited end of the inner conductor of the first sub-block opposite the electromagnetic coupling preventing structure is an input; and the connection conductor of the second laterally disposed hole of the second sub-block is an output.

20. The dielectric filter of claim 11, wherein each of the sub-blocks having inner conductors with open-circuited ends includes:

a first part extending from one end face to about the laterally disposed hole defining a first resonator; and a second part extending from the other end face to about the laterally disposed hole defining a second resonator, the first and second resonators being in series and joined at a common node;

the laterally disposed hole and connection conductor defining a shunt inductor coupled from the common node to the outer conductor.

21. The dielectric filter of claim 20, wherein each of the sub-blocks having inner conductors with short-circuited ends includes:

a first part extending from one end face to about the gap defining a first resonator;

a capacitor defined by the gap;

a second part extending from the other end face to about the second laterally disposed hole defining a second resonator, the first and second resonators being in series and joined by the capacitor;

the second disposed hole and connection conductor defining a output.

22. The dielectric filter of claim 21, wherein the resonators of adjacent sub-blocks are coupled together via respective phase shifters.

23. The dielectric filter of claim 13, comprising:

a first of said plurality of sub-blocks having an inner conductor with open-circuited ends and a first laterally disposed hole extending from a central part of its longitudinally extending through-hole to its outer surface, the first laterally disposed hole including a connection conductor which electrically connects the inner conductor with the outer conductor of the dielectric block;

a second of said plurality of sub-blocks having an inner conductor with short-circuited ends and being disposed adjacent to the first sub-block; and a third of said plurality of sub-blocks having an inner conductor with open-circuited ends and a second laterally disposed hole extending from a central part of its longitudinally extending through-hole to its outer surface, the second laterally disposed hole including a connection conductor which electrically connects the inner conductor with the outer conductor of the dielectric block, the third sub-block being disposed adjacent to the second sub-block.

24. The dielectric filter of claim 23, further comprising an electromagnetic coupling preventing structure disposed substantially adjacent to the second portion of the inner conductor of the second sub-block between each of the first and third sub-blocks, respectively.

25. The dielectric filter of claim 24, wherein the electromagnetic coupling preventing structures are defined by respective longitudinal slits extending from one end face of each of said adjacent sub-blocks toward the central part of said sub-blocks.

26. The dielectric filter of claim 25, wherein the longitudinal slits terminate at a location substantially adjacent to the gap of the second sub-block.

27. The dielectric filter of claim 23, further comprising an electrically conductive electrode disposed on and covering a portion of one of the end faces of the first sub-block, the electrode being proximate to the respective through-hole at the end face and being electrically connected to the respective inner conductor of the through-hole but electrically insulated from the outer conductor.

28. The dielectric filter of claim 27, wherein the conductive electrode is an input electrode.

29. The dielectric filter of claim 27, further comprising an electrically conductive electrode disposed on and covering a portion of one of the end faces of the third sub-block, the electrode being proximate to the respective through-hole at the end face and being electrically connected to the respective inner conductor of the through-hole but electrically insulated from the outer conductor.

30. The dielectric filter of claim 29, wherein the conductive electrode is an output electrode.

31. The dielectric filter of claim 23, wherein:

the open-circuited end of the inner conductor of the first sub-block opposite the electromagnetic coupling preventing structure is an input; and the open-circuited end of the inner conductor of the third sub-block opposite the electromagnetic coupling preventing structure is an output.

32. The dielectric filter of claim 23, wherein each of the sub-blocks having inner conductors with open-circuited ends includes:

a first part extending from one end face to about the laterally disposed hole defining a first resonator; and a second part extending from the other end face to about the laterally disposed hole defining a second resonator, the first and second resonators being in series and joined at a common node;

the laterally disposed hole and connection conductor defining a shunt inductor coupled from the common node to the outer conductor.

33. The dielectric filter of claim 32, wherein each of the sub-blocks having inner conductors with short-circuited ends includes:

a first part extending from one end face to about the gap defining a first resonator;

a capacitor defined by the gap;

a second part extending from the other end face to about the second laterally disposed hole defining a second resonator, the first and second resonators being in series and joined by the capacitor;

the second disposed hole and connection conductor defining a output.

34. The dielectric filter of claim 33, wherein the resonators of adjacent sub-blocks are coupled together via respective phase shifters.

35. A dielectric filter, comprising:

a dielectric block including a plurality of elongated sub-blocks each having a pair of longitudinally opposing end faces and an outer surface, said sub-blocks being disposed adjacent one another;

a plurality of longitudinally extending through-holes, at least one through-hole being formed between each corresponding pair of opposing end faces of the respective sub-blocks;

a plurality of inner conductors, one inner conductor being formed on each of the inner surfaces of said plurality of through-holes, said plurality of inner conductors each having two opposing ends;

an outer conductor formed on the outer surface of said dielectric block, the outer conductor not being electrically coupled to the respective ends of the inner conductors of the sub-blocks such that they are open-circuited;

a plurality of connection conductors through which respective parts of the inner conductors located between corresponding open-circuited opposing ends are connected to said outer conductor; and a respective electromagnetic coupling preventing structure formed between each adjacent pair of sub-blocks and extending from one end face of each of said sub-blocks toward a central part of said sub-blocks between the two opposing end faces, wherein said dielectric filter produces a band elimination transfer function over some frequencies and a band pass transfer function over other frequencies in use.

36. The dielectric filter of claim 35, wherein respective distances between corresponding pairs of opposing end faces define respective lengths of the sub-blocks, the lengths of the sub-blocks being substantially equal.

37. The dielectric filter of claim 36, wherein the adjacent sub-blocks are not substantially longitudinally shifted from one another.

38. The dielectric filter of claim 35, wherein each of the sub-blocks further comprises a laterally disposed hole extending from a substantially central part of its longitudinally extending through-hole to its outer surface, the laterally disposed hole including a respective one of said plurality of connection conductors which electrically communicates with the inner conductor of the longitudinally extending through-hole and the outer conductor of the dielectric block.

39. The dielectric filter of claim 38, comprising first, second, and third sub-blocks.

40. The dielectric filter of claim 35, wherein the electromagnetic coupling preventing structure is defined by a longitudinal slit extending from one end face of each of said adjacent sub-blocks toward the respective connection conductors.

41. The dielectric filter of claim 40, wherein the longitudinal slits terminate at a position substantially adjacent to the respective connection conductors.

42. The dielectric filter of claim 35, further comprising an electrically conductive electrode disposed on and covering a portion of one of the end faces of a first one of the sub-blocks, the electrode being proximate to the respective through-hole at the end face and being electrically connected to the respective inner conductor of the through-hole but electrically insulated from the outer conductor.

43. The dielectric filter of claim 42, wherein the conductive electrode is an input electrode.

44. The dielectric filter of claim 35, further comprising an electrically conductive electrode disposed on and covering a portion of one of the end faces of a third one of the sub-blocks, the electrode being proximate to the respective through-hole at the end face and being electrically connected to the respective inner conductor of the through-hole but electrically insulated from the outer conductor.

45. The dielectric filter of claim 44, wherein the conductive electrode is an output electrode.

46. The dielectric filter of claim 38, wherein each of the sub-blocks includes:

a first part extending from one end face to about the laterally disposed hole defining a first resonator; and a second part extending from the other end face to about the laterally disposed hole defining a second resonator, the first and second resonators being in series and joined at a common node;

the laterally disposed hole and the connection conductor defining a shunt inductor coupled from the common node to the outer conductor.

47. The dielectric filter of claim 46, wherein the resonators of adjacent sub-blocks are coupled together via respective phase shifters.

* * * * *